US011841633B2

(12) United States Patent
Horiuchi

(10) Patent No.: US 11,841,633 B2
(45) Date of Patent: Dec. 12, 2023

(54) IMAGE FORMING APPARATUS

(71) Applicant: CANON KABUSHIKI KAISHA, Tokyo (JP)

(72) Inventor: Izuru Horiuchi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 146 days.

(21) Appl. No.: 17/702,143

(22) Filed: Mar. 23, 2022

(65) Prior Publication Data

US 2022/0342336 A1 Oct. 27, 2022

(30) Foreign Application Priority Data

Apr. 26, 2021 (JP) ..... 2021-074061

(51) Int. Cl.
*G03G 15/043* (2006.01)
*G03G 15/04* (2006.01)
*G03G 15/041* (2006.01)

(52) U.S. Cl.
CPC ..... *G03G 15/0435* (2013.01); *G03G 15/043* (2013.01); *G03G 15/04054* (2013.01); *G03G 15/04* (2013.01); *G03G 15/041* (2013.01)

(58) Field of Classification Search
CPC ..... G03G 15/0435; G03G 15/04054; G03G 15/043; G03G 15/04; G03G 15/041
See application file for complete search history.

(56) References Cited

U.S. PATENT DOCUMENTS

2008/0180143 A1 7/2008 Shigemori et al.
2013/0155164 A1* 6/2013 Kamei ..... G03G 15/04054 347/118
2013/0308969 A1* 11/2013 Hasegawa ..... G03G 15/5033 399/50

(Continued)

*Primary Examiner* — Henok D Legesse
(74) *Attorney, Agent, or Firm* — Venable LLP

(57) ABSTRACT

An image forming apparatus includes a photoreceptor; an image signal generating unit configured to generate an image signal based on input image data; a light emitting portion configured to emit light based on the image signal and expose the photoreceptor; a driving unit configured to drive the light emitting portion; a first substrate in which the driving unit is provided and a plurality of the light emitting portions is provided in a direction parallel to a rotational axis direction of the photoreceptor; an exposure head including the first substrate; a reference clock signal generating unit configured to generate a reference clock signal that is a clock signal of a constant frequency; a modulated clock signal generating unit configured to generate a modulated clock signal by performing spread spectrum on the reference clock signal, the modulated clock signal being a composite wave in which odd-order harmonics are combined with a fundamental wave when a triangular wave is subjected to Fourier series expansion; a transmission unit configured to superimpose the modulated clock signal on the image signal and transmit the superimposed signal to the first substrate; a second substrate on which the image signal generating unit, the modulated clock signal generating unit, and the transmission unit are provided; and an extraction circuit that is (Continued)

mounted on the first substrate and extracts the modulated clock signal from the superimposed signal transmitted from the transmission unit.

7 Claims, 19 Drawing Sheets

(56) References Cited

U.S. PATENT DOCUMENTS

| | | | | |
|---|---|---|---|---|
| 2015/0346628 | A1 | 12/2015 | Yokoi | |
| 2016/0062290 | A1* | 3/2016 | Ishida | G03G 15/04027 399/39 |
| 2020/0333723 | A1 | 10/2020 | Horiuchi | |

* cited by examiner

IMAGE FORMING APPARATUS

BACKGROUND OF THE INVENTION

Field of the Invention

The present invention relates to an image forming apparatus such as an electro-photographic copying machine or an electro-photographic printer that forms an image on a sheet using an electrophotographic system.

Description of the Related Art

When an image is formed by an image forming apparatus of an electrophotographic system, first, an electrostatic latent image is formed on a surface of a photoreceptor by irradiating the surface of the photoreceptor with light according to an image signal. Thereafter, toner is attached to the electrostatic latent image on the surface of the photoreceptor by a developing device to form a toner image, the toner image is transferred to a sheet, and the toner image transferred to the sheet is heated by a fixing device to be fixed to the sheet.

In addition, in an image forming apparatus, a configuration in which the electrostatic latent image is formed by irradiating the photoreceptor with light by an exposure head is known. The exposure head includes a plurality of the light emitting portions arranged in a rotational axis direction of the photoreceptor and a lens that forms an image of light emitted from the plurality of light emitting portions on a surface of the photoreceptor. Then, the plurality of light emitting portions sequentially emits light to form one scanning line extending in the main scanning direction, and this is repeated to form the electrostatic latent image. As the light emitting portion, an LED, an organic EL, or the like is used. By using such an exposure head, it is possible to reduce the number of components as compared with a configuration of a laser scanning method in which laser light is deflected and scanned by a rotary polygon mirror to form the electrostatic latent image, and it is possible to reduce the size and manufacturing cost of the image forming apparatus.

Here, the exposure head has a structure in which wiring that transmits a drive signal that drives the light emitting portion serves as an antenna and tends to be a source of radiation noise. On the other hand, US 2015/0346628 describes a configuration in which a system clock is spectrally spread by a spread spectrum clock generator (SSCG) to suppress a peak frequency gain of a radiation noise component as a countermeasure against radiation noise.

Various members such as a charging device that charges the photoreceptor, an exposure head, and a developing device configured to develop an electrostatic latent image are disposed around the photoreceptor. Therefore, in order to secure an arrangement space for other members around the photoreceptor, an electronic component that generates a signal such as an image signal used in the exposure head is generally mounted on a control substrate that is a substrate different from the substrate included in the exposure head, and the exposure head is downsized.

Here, in communication between the control substrate and the substrate of the exposure head, a clock signal may be superimposed on an image signal generated on the control substrate side, and a clock signal superimposed on the substrate side of the exposure head may be extracted by a phase locked loop (PLL) circuit. By thus superimposing the clock signal on the image signal sent from the control substrate to the substrate of the exposure head, the number of signal lines connecting the control substrate and the substrate of the exposure head can be reduced.

However, in the configuration in which the PLL circuit is provided on the substrate of the exposure head, when the modulated clock signal generated by the SSCG is used as the clock signal superimposed on the image signal, the image signal may not be received normally by the exposure head. This will be described below.

First, as a modulation waveform of frequency modulation in spread spectrum, a method of modulating to a triangular wave illustrated in FIG. 19A and a method of modulating to a sine wave illustrated in FIG. 19B are known. The triangular wave has a larger effect of dispersing the frequency than the sine wave. Therefore, the triangular wave is more effective as a countermeasure against radiation noise than the sine wave as a modulation waveform of frequency modulation in spread spectrum. However, as can be seen by Fourier series expansion of the triangular wave, the triangular wave includes the fundamental wave and infinite odd-order harmonic components.

On the other hand, the PLL circuit (an extraction circuit) is provided with a low-pass filter that reduces a frequency component higher than the cut-off frequency in the signal. Therefore, in a case where the modulation waveform of spread spectrum is a triangular wave including a fundamental wave and infinite odd-order harmonic components, the harmonic components higher than the cut-off frequency of the modulated clock signal are reduced by the low-pass filter of the PLL circuit.

In this case, the modulated clock signal transmitted from the control substrate to the substrate of the exposure head and the modulated clock signal processed by the PLL circuit have different cycles. That is, since the cycles of the clock signals are different between the transmission side and the reception side, there is a possibility of the signal not being transmitted and received normally between the control substrate and the substrate of the exposure head, and the image signal not being received normally by the exposure head.

SUMMARY OF THE INVENTION

A representative configuration of an image forming apparatus according to the present invention is an image forming apparatus comprising:

a photoreceptor;

an image signal generating unit configured to generate an image signal based on input image data;

a light emitting portion configured to emit light based on the image signal and expose the photoreceptor;

a driving unit configured to drive the light emitting portion;

a first substrate in which the driving unit is provided and a plurality of the light emitting portions is provided in a direction parallel to a rotational axis direction of the photoreceptor;

an exposure head including the first substrate;

a reference clock signal generating unit configured to generate a reference clock signal that is a clock signal of a constant frequency;

a modulated clock signal generating unit configured to generate a modulated clock signal by performing spread spectrum on the reference clock signal, the modulated clock signal being a composite wave in which odd-order harmonics are combined with a fundamental wave when a triangular wave is subjected to Fourier series expansion;

a transmission unit configured to superimpose the modulated clock signal on the image signal and transmit the superimposed signal to the first substrate;

a second substrate on which the image signal generating unit, the modulated clock signal generating unit, and the transmission unit are provided; and an extraction circuit that is mounted on the first substrate and extracts the modulated clock signal from the superimposed signal transmitted from the transmission unit.

DESCRIPTION OF THE EMBODIMENTS

<Image Forming Apparatus>

Hereinafter, an overall configuration of an image forming apparatus A according to the present invention will be described with reference to the drawings together with an operation at the time of image formation. The dimensions, materials, shapes, relative arrangements, and the like of the components described below are not intended to limit the scope of the present invention only to them unless otherwise specified.

The image forming apparatus A is a full-color image forming apparatus that transfers toners of the four colors yellow Y, magenta M, cyan C, and black K to a sheet to form an image. In the following description, Y, M, C, and K are added as suffixes to members using the toners of the respective colors, but the configurations and operations of the members are substantially the same except that the colors of the toners to be used are different, and thus the suffixes are appropriately omitted unless distinction is required.

Figure 1:
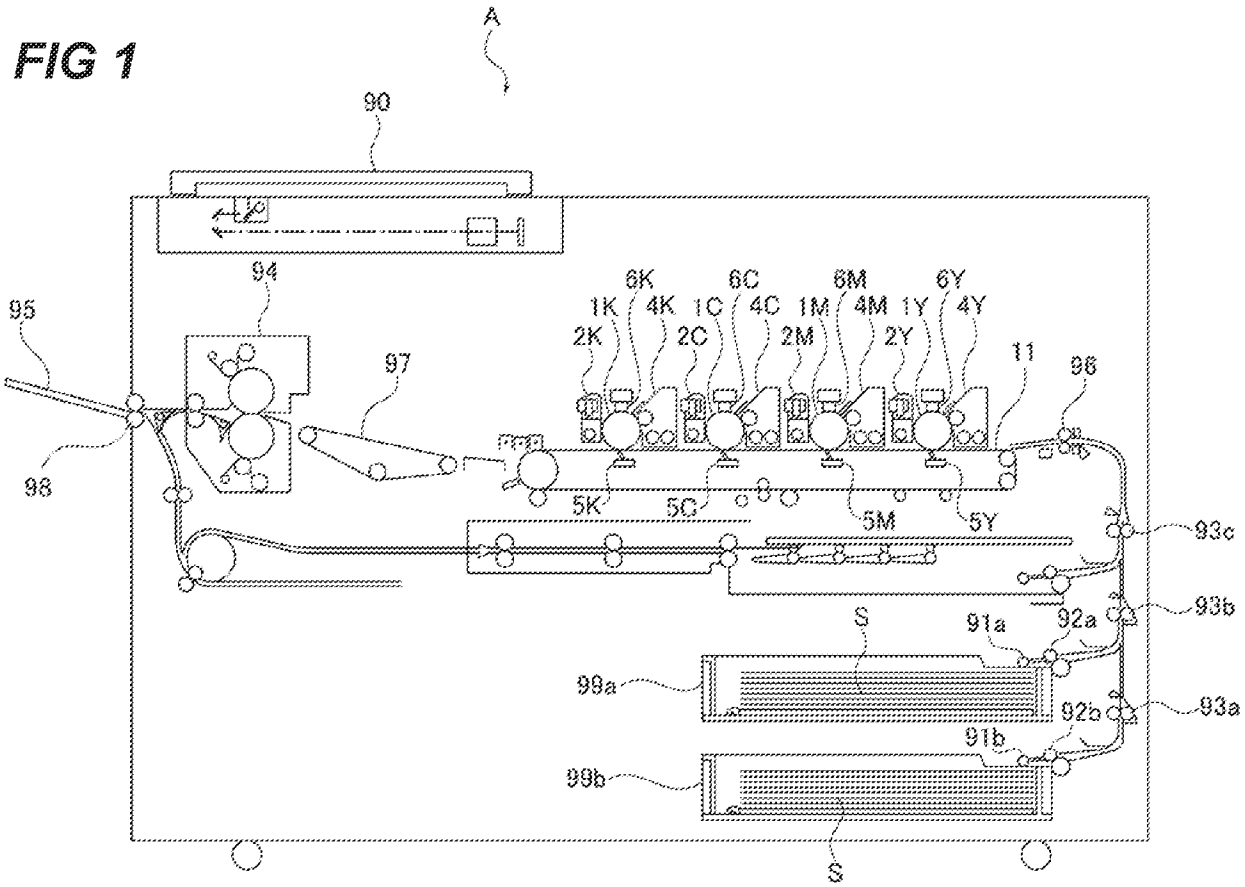
FIG. 1 is a schematic cross-sectional view of an image forming apparatus.

FIG. 1 is a schematic cross-sectional view of the image forming apparatus A. As illustrated in FIG. 1, the image forming apparatus A includes an image forming portion that forms an image. The image forming portion includes a photosensitive drum 1 (1Y, 1M, 1C, and 10 K) as a photoreceptor, a charging device 2 (2Y, 2M, 2C, and 2K), an exposure head 6 (6Y, 6M, 6C, and 6K), a developing device 4 (4Y, 4M, 4C, and 4K), and a transfer device 5 (5Y, 5M, 5C, and 5K).

Next, an image forming operation by the image forming apparatus A will be described. In the case of forming an image, first, a sheet S stored in a sheet cassette 99*a* or a sheet cassette 99*b* is sent to a registration roller 96 by pickup rollers 91*a* and 91*b*, feeding rollers 92*a* and 92*b*, and conveying rollers 93*a* to 93*c*. Thereafter, the sheet S is fed to a conveying belt 11 at a predetermined timing by the registration roller 96.

On the other hand, in the image forming portion, first, the surface of the photosensitive drum 1Y is charged by the charging device 2Y. Next, the exposure head 6Y irradiates the surface of the photosensitive drum 1Y with light corresponding according to image data read by the image reading portion 90 or image data transmitted from an external device (not illustrated) to form an electrostatic latent image on the surface of the photosensitive drum 1Y. Thereafter, a yellow toner is attached to the electrostatic latent image formed on the surface of the photosensitive drum 1Y by the developing device 4Y, and a yellow toner image is formed on the surface of the photosensitive drum 1Y. When a transfer bias is applied to the transfer device 5Y, the toner image formed on the surface of the photosensitive drum 1Y is transferred to the sheet S being conveyed by the conveying belt 11.

By a similar process, the photosensitive drums 1M, 1C, and 1K are also irradiated with light from the exposure heads 6M, 6C, and 6K to form electrostatic latent images, and toner images of magenta, cyan, and black are formed by the developing devices 4M, 4C, and 4K. Then, when the transfer bias is applied to the transfer devices 5M, 5C, and 5K, these toner images are transferred over the yellow toner image on the sheet S. As a result, a full-color toner image corresponding to the image data is formed on the surface of the sheet S.

Thereafter, the sheet S carrying the toner image is conveyed to the fixing device 94 by the conveying belt 97, and subjected to heating and pressurization processing in the fixing device 94. As a result, the toner image on the sheet S is fixed to the sheet S. Thereafter, the sheet S on which the toner image is fixed is discharged to a discharge tray 95 by a discharge roller 98.

<Exposure Head>

Next, a configuration of the exposure head 6 will be described.

Figure 2A:
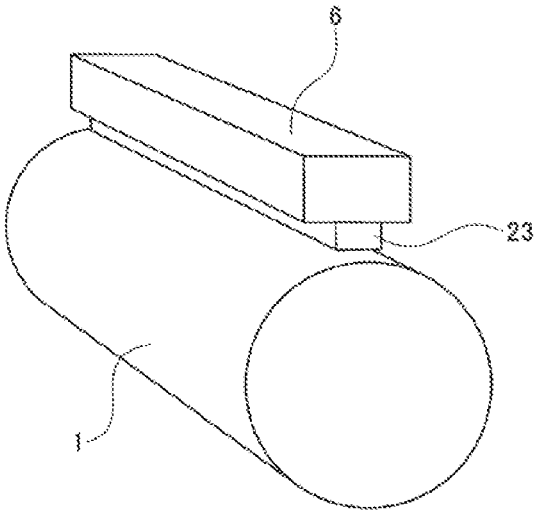
FIG. 2A illustrates a perspective view of a photosensitive drum and an exposure head.
Figure 2B:
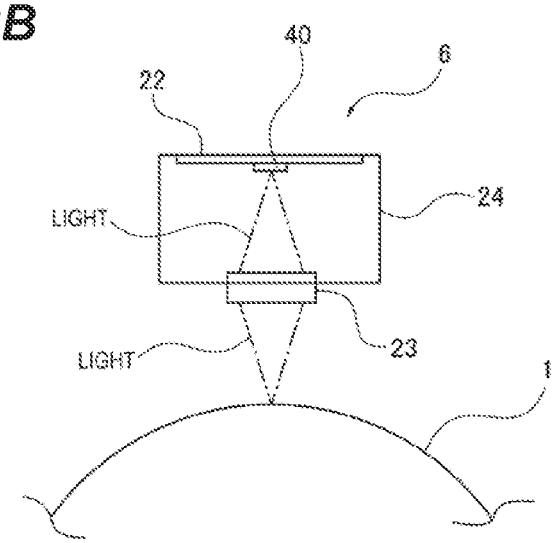
FIG. 2B illustrates a cross-sectional view of a photosensitive drum and an exposure head.
Figure 3A:
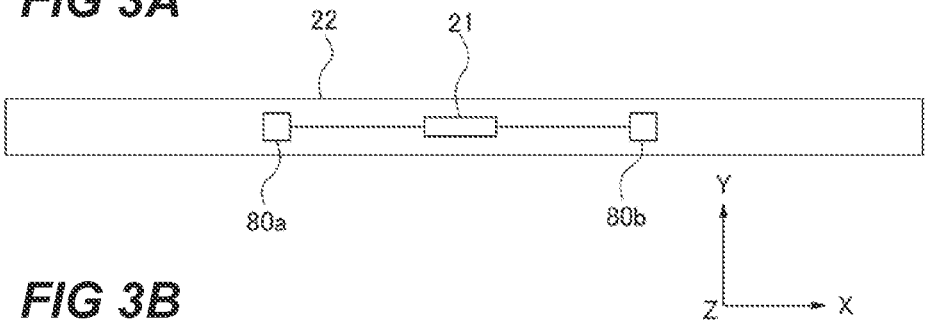
FIG. 3A, FIG. 3B and FIG. 3C are views illustrating a mounting surface of a print substrate included in the exposure head.
Figure 3B:
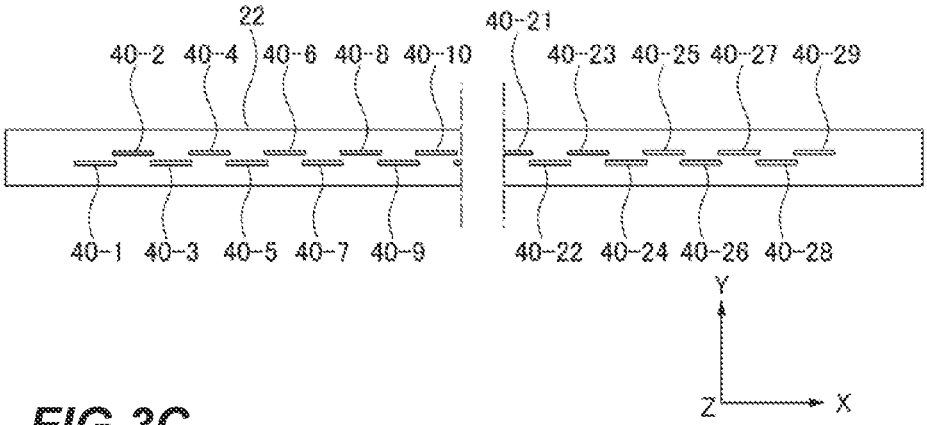
Figure 3C:
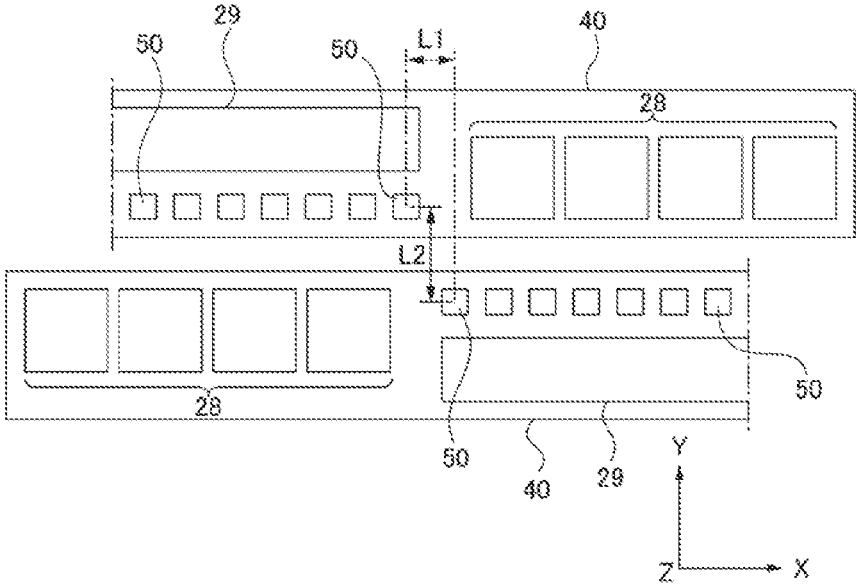

FIG. 2A is a perspective view of the photosensitive drum 1 and the exposure head 6. FIG. 2B is a cross-sectional view of the photosensitive drum 1 and the exposure head 6. FIGS. 3A and 3B are views illustrating mounting surfaces on one side and the other side of a print substrate 22 included in the exposure head 6. FIG. 3C is a schematic view illustrating a positional relationship between light emitting element array chips 40 adjacent in the arrow Y direction.

As illustrated in FIG. 2A and FIG. 2B, the exposure head 6 is fixed at a position facing the surface of the photosensitive drum 1 by a fixing member (not illustrated). The exposure head 6 includes the light emitting element array chip 40 which is an LED array that emits light and a print substrate 22 (a first substrate) on which the light emitting element array chip 40 is mounted. In addition, there are provided a rod lens array 23 that forms an image of (condenses) the light emitted from the light emitting element array chip 40 on the photosensitive drum 1, and a housing 24 to which the rod lens array 23 and the print substrate 22 are fixed.

As illustrated in FIG. 3A, FIG. 3B and FIG. 3C, on the print substrate 22, 29 light emitting element array chips 40 are mounted in a staggered arrangement in two rows. In each light emitting element array chip 40, 516 light emitting portions 50 (the light emitting elements) are arranged at a predetermined resolution pitch in the longitudinal direction (the arrow X direction).

In the present embodiment, the resolution pitch of the light emitting element array chip 40 is 1200 dpi (about 21.16 μm). In addition, the distance from one end portion to the other end portion in the longitudinal direction of the light emitting portion 50 in each light emitting element array chip 40 is about 10.9 mm. That is, the exposure head 6 includes a total of 14964 light emitting portions 50 in the arrow X direction, which enables exposure processing corresponding to an image width in the longitudinal direction of about 316 mm (≈about 10.9 mm×29 chips).

In the longitudinal direction of the light emitting element array chip 40, an interval L1 between the light emitting portions 50 of the adjacent light emitting element array chips 40 is about 21.16 μm. That is, the pitch in the longitudinal direction of the light emitting portion 50 is a pitch of a resolution of 1200 dpi at the boundary portion of each light emitting element array chip 40. In addition, in the lateral direction (the arrow Y direction) of the light emitting element array chip 40, the interval L2 between the light emitting portions 50 of the adjacent light emitting element array chips 40 is about 84 μm (4 pixels at 1200 dpi, 8 pixels at 2400 dpi).

In addition, the light emitting element array chip 40 is provided with a wire bonding pad 28 for outputting and inputting a signal to and from the light emitting element array chip 40. A transfer portion 29 and the light emitting portion 50 of the light emitting element array chip 40 are driven by a signal input from the wire bonding pad 28.

A connector 21 is mounted on a surface of the print substrate 22 opposite to the mounting surface of the light emitting element array chip 40. On both sides of the connector 21 in the arrow X direction, a driving portion 80*a* that drives light emitting element array chips 40-1 to 40-15 and a driving portion 80*b* that drives light emitting element array chips 40-16 to 40-29 are provided. The driving portion 80*a* and the driving portion 80*b* are examples of the driving unit.

Wiring for driving the light emitting element array chip 40 is connected from the driving portions 80*a* and 80*b* to each of the light emitting element array chips 40 through the inner layer of the print substrate 22. The connector 21 is provided to transmit control signals of the driving portions 80*a* and 80*b* transmitted from an image controller portion 70 (FIG. 4) and to connect a power supply line and a ground line.

In the present embodiment, the arrow X direction, which is the longitudinal direction of the light emitting element array chip 40, is one direction parallel to the rotational axis direction of the photosensitive drum 1, and is also the main scanning direction. In addition, the arrow Y direction, which is the lateral direction of the light emitting element array chip 40, is the rotation direction of the photosensitive drum 1, and is also the sub-scanning direction. The arrow Z direction is a direction orthogonal to the arrow X direction and the arrow Y direction. The longitudinal direction of the light emitting element array chip 40 may be inclined by about ±1° with respect to the rotational axis direction of the photosensitive drum 1. In addition, the lateral direction of the light emitting element array chip 40 may also be inclined by about ±1° with respect to the rotation direction of the photosensitive drum 1.

<System Configuration of Exposure Head>

Next, a system configuration of the exposure head 6 and the image controller portion 70 will be described.

The image controller portion 70 (the second substrate) is a substrate provided on the main body side of the image forming apparatus A, that is, outside the exposure head 6, and is a substrate on which electronic components for performing image processing and the like are mounted. That is, the print substrate 22 of the exposure head 6 and the image controller portion 70 are different substrates. By disposing the image controller portion 70 on the main body side of the image forming apparatus A instead of the exposure head 6 in this manner, the print substrate 22 of the exposure head 6 can be downsized, and the exposure head 6 can be downsized. Therefore, it is easy to secure a space for disposing the charging device 2 and the developing device 4 around the photosensitive drum 1.

Although processing of a single color among four colors of yellow, magenta, cyan, and black will be described below, similar processing is performed in parallel for the four colors in the image forming operation. In addition, although the system configuration between the driving portion 80*a* and the light emitting element array chips 40-1 to 40-15 will be described below, the same applies to the system configuration between the driving portion 80*b* and the light emitting element array chips 40-16 to 40-29.

Figure 4:
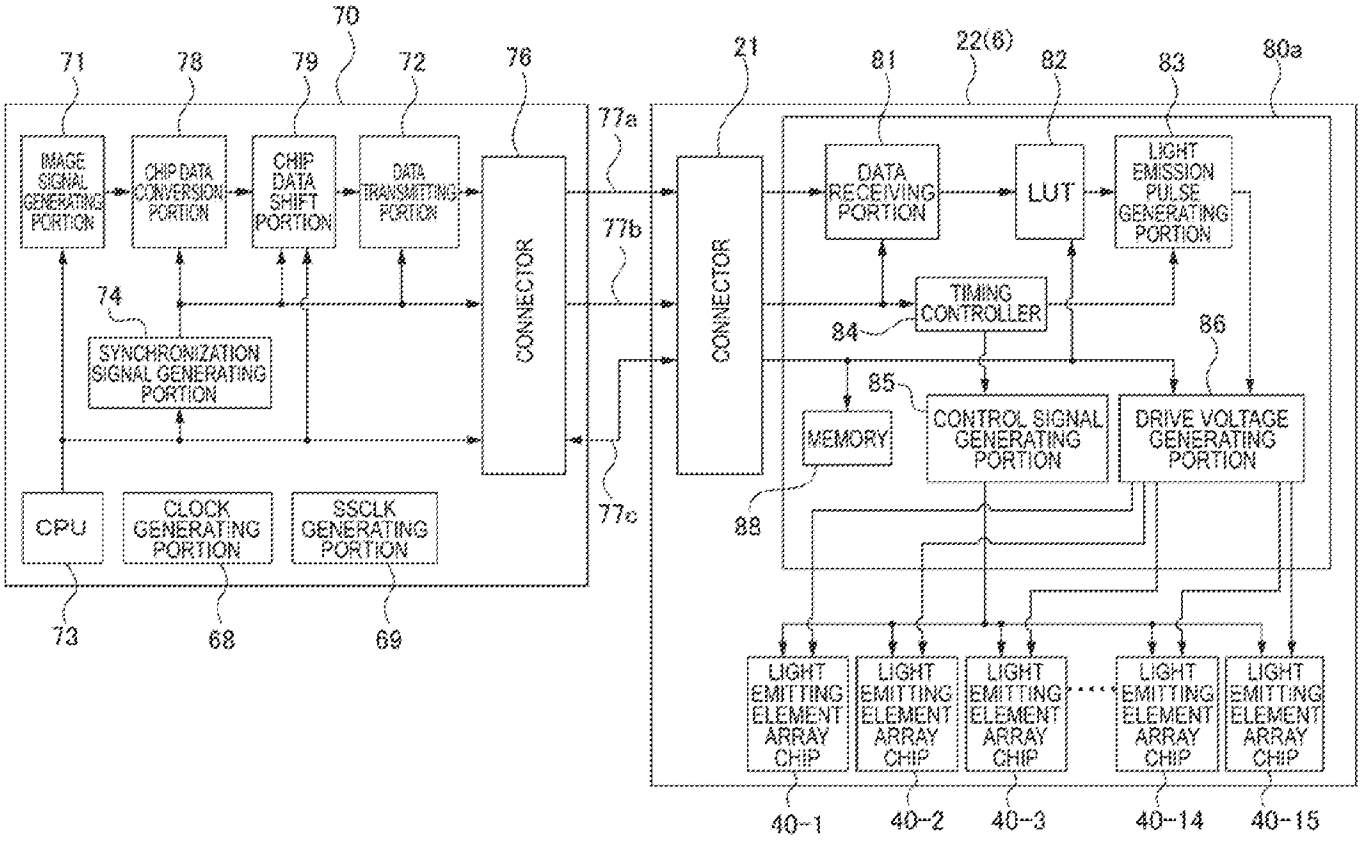
FIG. 4 is a block diagram illustrating a system configuration of an image controller portion and the exposure head.

FIG. 4 is a block diagram illustrating a system configuration of the image controller portion 70 and the print substrate 22 of the exposure head 6. As illustrated in FIG. 4, the image controller portion 70 includes a clock generating portion 68, an SSCLK generating portion 69, an image signal generating portion (an image signal generating unit) 71, a data transmitting portion (a transmission unit) 72, a CPU 73, a synchronization signal generating portion 74, a chip data conversion portion 78, and a chip data shift portion 79.

The image controller portion 70 performs processing of image data and processing of image formation timing by the above-described portions, and transmits a control signal for controlling the exposure head 6 to the print substrate 22 of the exposure head 6. Specifically, the control signal is an image signal, a line synchronization signal, a communication signal of the CPU 73, a modulated clock signal, or the like. These signals are transmitted from a connector 76 mounted on the image controller portion 70 to the print substrate 22 via cables 77*a* to 77*c* and the connector 21 mounted on the print substrate 22. In the present embodiment, the connector 76 and the connector 21 are connected by a flexible flat cable. The flexible flat cable has a plurality of signal lines. The cables 77*a* to 77*c* correspond to several of the plurality of signal lines. As the length of the flexible flat cable is longer, the flexible flat cable is more susceptible to noise. In the case of a color machine, a signal is transmitted from the image controller portion 70 through the flexible flat cable for each exposure head corresponding to each color. Then, a signal transmitted through a certain flexible flat cable may affect a signal transmitted through another flexible flat cable. That is, the noise problem appears more remarkably in the color machine than in a monochrome machine.

The clock generating portion 68 (the reference clock signal generating unit) generates a reference clock signal, and inputs the reference clock signal to the image signal generating portion 71, a data transmitting portion 72, the CPU 73, the synchronization signal generating portion 74, and a chip data conversion portion 78. The reference clock signal is a clock signal having a constant frequency. This frequency is a value determined in advance to achieve desired specifications such as process speed and output resolution of the image forming apparatus A. In the drawings, the reference clock signal is denoted as "CLK" as necessary. In FIG. 4, signal lines for transmitting the reference clock signal are omitted.

The SSCLK generating portion 69 (the modulated clock signal generating unit) is a spread spectrum clock generator (SSCG) IC. The SSCLK generating portion 69 generates a modulated clock signal obtained by performing frequency modulation (the spread spectrum) on the reference clock signal generated by the clock generating portion 68. The SSCLK generating portion 69 inputs a modulated clock signal to the data transmitting portion 72, the synchronization signal generating portion 74, the chip data conversion portion 78, and the chip data shift portion 79. In the drawings, the modulated clock signal is denoted as "SSCLK" as necessary. In FIG. 4, signal lines for transmitting the modulated clock signal are omitted.

That is, both the reference clock signal and the modulated clock signal are input to the data transmitting portion 72, the synchronization signal generating portion 74, and the chip data conversion portion 78. The synchronization signal generating portion 74 generates a first line synchronization signal based on the reference clock signal and generates a second line synchronization signal based on the modulated clock signal (see FIG. 10). In addition, the data transmitting portion 72 performs clock transfer processing from the reference clock signal to the modulated clock signal, and transmits various signals to the data receiving portion 81 of the exposure head 6 as described later.

The CPU 73 sets a modulation cycle and intensity of the modulated clock signal generated by the SSCLK generating portion 69. In the present embodiment, the modulation cycle of the modulated clock signal is set to twice the exposure cycle of one light emitting element array chip 40. In addition, the intensity of the modulated clock signal can be set in a range of 0.1% to 5%, and is set to a value as small as possible within a range in which radiation noise can be sufficiently reduced.

Image data of an original read by the image reading portion 90 and image data transferred from an external device via a network are input to the image signal generating portion 71. The image signal generating portion 71 performs dithering processing on the input image data with a resolution instructed by the CPU 73, and generates an image signal for outputting an image.

The synchronization signal generating portion 74 periodically generates a line synchronization signal that is a signal indicating a time interval of one line. The CPU 73 sets, as one line cycle, a cycle in which the surface of the photosensitive drum 1 moves in the rotation direction by a distance corresponding to the resolution in the sub-scanning direction of the image formed by the image forming apparatus A with respect to the rotation speed of the photosensitive drum 1 set in advance, and instructs the synchronization signal generating portion 74 on the time interval of the signal cycle. The rotation speed of the photosensitive drum 1 is calculated by the CPU 73 based on a set value stored in a storage portion (not illustrated).

The chip data conversion portion 78 receives the image signal line by line from the image signal generating portion 71 in synchronization with the line synchronization signal. The chip data conversion portion 78 arranges the input image signal so that the image signal can be used in each of the light emitting element array chips 40-1 to 40-29.

The chip data shift portion 79 shifts the image signal in the sub-scanning direction in units of 2400 dpi for each light emitting element array chip 40 based on the position correction information of each light emitting element array chip 40 instructed by the CPU 73. The CPU 73 calculates the position correction information by adding the interval in the sub-scanning direction of each light emitting element array chip 40 (in the present embodiment, 8 pixels at 2400 dpi) and the deviation of the mounting position of each light emitting element array chip 40 measured in advance, and instructs the chip data shift portion 79 on the shift amount of the image signal.

The data transmitting portion 72 (the transmitting portion) transmits various signals generated by the image controller portion 70 to the data receiving portion 81 of the exposure head 6 via the cables 77*a* to 77*c*. Specifically, the image signal output from the image signal generating portion 71 is transmitted via the cable 77*a*. The line synchronization signal (the first line synchronization signal and the second line synchronization signal) generated by the synchronization signal generating portion 74 is transmitted via the cable 77*b*. The communication signal generated by the CPU 73 is transmitted via the cable 77*c*. The data transmitting portion 72 transmits the image signal to the data receiving portion 81 in units of lines in synchronization with the line synchronization signal.

In addition, the data transmitting portion 72 multiplies the modulated clock signal, superimposes the modulated clock signal on the image signal to convert the modulated clock signal into a serial signal, and transmits the serial signal to the data receiving portion 81. As a result, stable communication is performed between the data transmitting portion 72 and the data receiving portion 81 using a small number of signal lines.

The image signal received by the data receiving portion 81 is input to a LUT 82. The light emitting portion 50 of the light emitting element array chip 40 has a characteristic that a relationship between the exposure time and the light quantity is non-linear. The LUT 82 corrects and outputs the input image signal such that the relationship between the exposure time and the light quantity has a linear line. The driving portion 80*a* includes a circuit that processes image signals corresponding to the light emitting element array chips 40-1 to 40-15 in parallel for each light emitting element array chip 40.

A light emission pulse generating portion 83 generates a pulse width signal (a PWM signal) corresponding to the light emission time during which the light emitting element array chip 40 emits light in one pixel section according to the data value of the image signal input from the LUT 82. The timing at which the light emission pulse generating portion 83 outputs the PWM signal is controlled by a timing controller 84. Specifically, the timing controller 84 generates a synchronization signal corresponding to a pixel section of each pixel by the second line synchronization signal generated by the synchronization signal generating portion 74 and transmits the synchronization signal to the light emission pulse generating portion 83, and the light emission pulse generating portion 83 outputs the PWM signal according to the received synchronization signal.

A drive voltage generating portion 86 generates a drive voltage that drives the light emitting element array chip 40 in synchronization with the PWM signal. The drive voltage generating portion 86 is configured such that the voltage level of the output signal can be adjusted around 5V by the CPU 73 such that the light quantity of the light emitting portion 50 of the light emitting element array chip 40 becomes a predetermined light quantity. In the present embodiment, each light emitting element array chip 40 has a configuration capable of independently driving the four light emitting portions 50 at the same time. The drive voltage generating portion 86 supplies drive signals to 4 lines for each of the light emitting element array chips 40, and supplies drive signals to 1 line (15 chips)×4=60 lines in a staggered configuration in the entire exposure head 6. The drive signals supplied to the light emitting element array chips 40 are set to ΦW1 to ΦW4 (see FIG. 5). On the other hand, the light emitting element array chip 40 is sequentially driven by the operation of a shift thyristor (see FIG. 5) to be described later. A control signal generating portion 85 generates control signals Φs, Φ1, and Φ2 for transferring the shift thyristor for each pixel from the synchronization signal corresponding to the pixel section generated by the timing controller 84 (see FIG. 5).

<SLED Circuit>

Next, a SLED circuit will be described.

Figure 5:
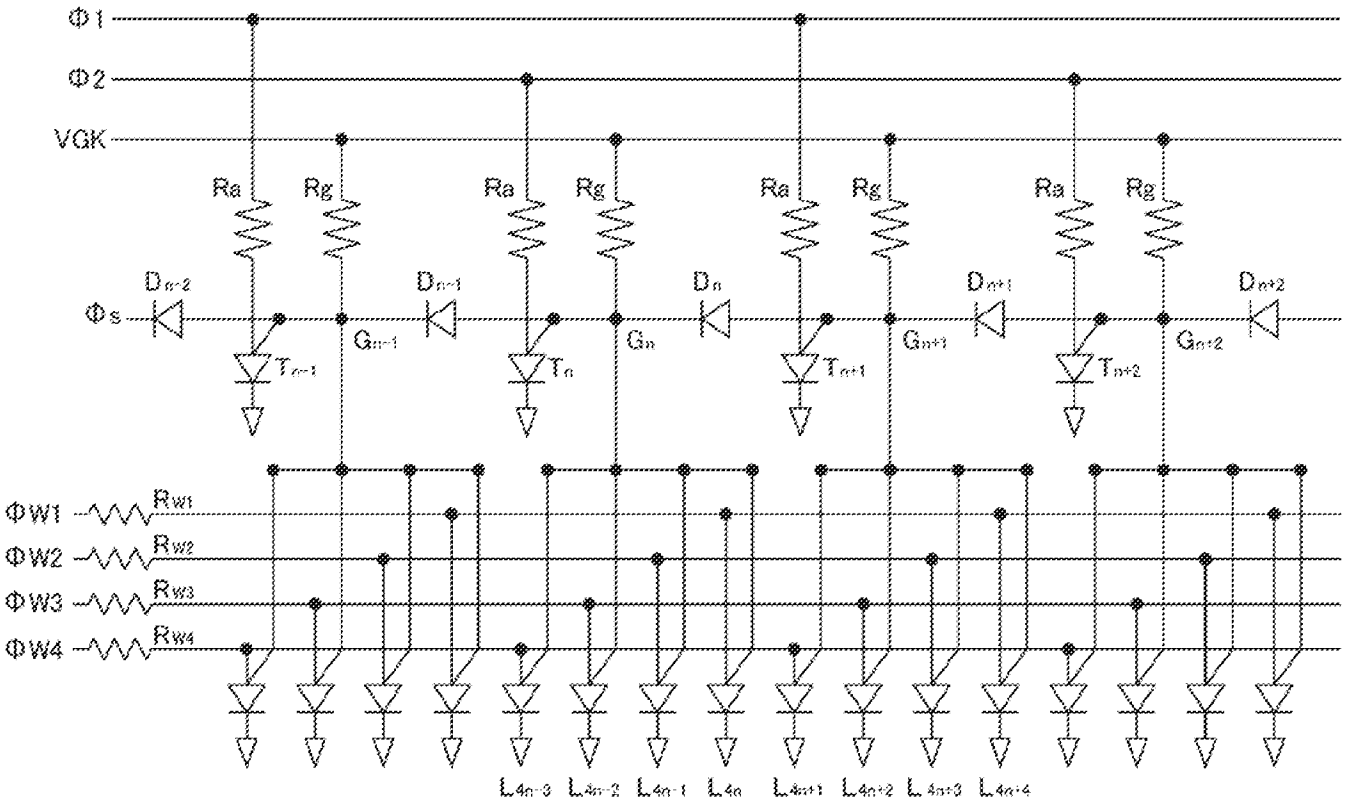
FIG. 5 is a diagram for illustrating a circuit of a light emitting element array chip.

FIG. 5 is an equivalent circuit obtained by extracting a part of a self-scanning light emitting element (SLED) chip array of the present embodiment. In FIG. 5, Ra and Rg indicate an anode resistance and a gate resistance, respectively, Tn indicates a shift thyristor, Dn indicates a transfer diode, and Ln indicates a light-emitting thyristor. In addition, Gn represents a common gate of the corresponding shift thyristor Tn and the light-emitting thyristor Ln connected to the shift thyristor Tn. Here, n is an integer of 2 or more. Φ1 is a transfer line of the odd-numbered shift thyristor T, and Φ2 is a transfer line of the even-numbered shift thyristor T. ΦW1 to ΦW4 are turn-on signal lines of the light-emitting thyristor L, and are connected to the resistors RW1 to RW4, respectively. VGK is the gate line and Φs is the start pulse line. As illustrated in FIG. 5, four light-emitting thyristors L4*n*−3 to L4*n* are connected to one shift thyristor Tn, and four light-emitting thyristors L4*n*−3 to L4*n* can be turned on at the same time.

Next, the operation of the SLED circuit illustrated in FIG. 5 will be described. In the circuit diagram of FIG. 5, it is assumed that 5 V is applied to the gate line VGK, and voltages input to the transfer lines Φ1 and Φ2 and the turn-on signal lines ΦW1 to ΦW4 are also set to 5 V.

In FIG. 5, when the shift thyristor Tn is in the on state, the potential of the shift thyristor Tn and a common gate Gn of the light-emitting thyristor Ln connected to the shift thyristor Tn is lowered to about 0.2 V. Since the common gate Gn of the light-emitting thyristor Ln and a common gate Gn+1 of the light-emitting thyristor Ln+1 are connected by a coupling diode Dn, a potential difference substantially equal to the diffusion potential of the coupling diode Dn is generated. In the present embodiment, since the diffusion potential of the coupling diode Dn is about 1.5 V, the potential of the common gate Gn+1 of the light-emitting thyristor Ln+1 is 1.7 V (=0.2 V+1.5 V) obtained by adding 1.5 V of the diffusion potential to 0.2 V of the potential of the common gate Gn of the light-emitting thyristor Ln.

Hereinafter, similarly, the potential of a common gate Gn+2 of the light-emitting thyristor Ln+2 is 3.2 V (=1.7 V+1.5 V), and the potential of a common gate Gn+3 (not illustrated) of the light-emitting thyristor Ln+3 (not illustrated) is 4.7 V (=3.2 V+1.5 V). However, the potential after a common gate Gn+4 of a light-emitting thyristor Ln+4 is 5 V because the voltage of the gate line VGK is 5 V and is not higher than 5 V. Further, with respect to the potential of the common gate Gn−1 before the common gate Gn of the light-emitting thyristor Ln (on the left side of the common gate Gn in FIG. 5), since the coupling diode Dn−1 is in the reverse bias state, the voltage of the gate line VGK is applied as it is and becomes 5 V.

Figure 6A:
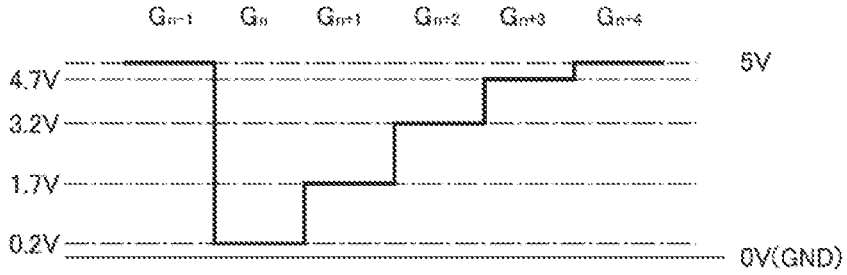
FIG. 6A, FIG. 6B and FIG. 6C are diagrams for illustrating a distribution state of a gate potential of a shift thyristor.

FIG. 6A is a diagram illustrating the distribution of the gate potential of the common gate Gn of each light-emitting thyristor Ln when the above-described shift thyristor Tn is in the ON state, and the common gates Gn−1, Gn, Gn+1, . . . refer to the common gate of the light-emitting thyristor L in FIG. 5. In FIG. 6A, the vertical axis represents the gate potential.

A voltage (hereinafter, a "threshold voltage") necessary for turning on each of the shift thyristors Tn is substantially the same as a potential obtained by adding a diffusion potential (1.5 V) to the gate potential of the common gate Gn of each of the light-emitting thyristors Ln. When the shift thyristor Tn is turned on, the shift thyristor Tn+2 has the lowest gate potential of the common gate among the shift thyristors connected to the line of the transfer line Φ2 of the same shift thyristor Tn. The potential of the common gate Gn+2 of the light-emitting thyristor Ln+2 connected to the shift thyristor Tn+2 is 3.2 V (=1.7 V+1.5 V) (FIG. 6A) as described above. Therefore, the threshold voltage of the shift thyristor Tn+2 is 4.7 V (=3.2 V+1.5 V). However, since the shift thyristor Tn is turned on, the potential of the transfer line Φ2 is drawn to about 1.5 V (a diffusion potential), and is lower than the threshold voltage of the shift thyristor Tn+2, so that the shift thyristor Tn+2 cannot be turned on. Since the other shift thyristors connected to the same transfer line Φ2 have a threshold voltage higher than that of the shift thyristor Tn+2, the other shift thyristors cannot be similarly turned on, and only the shift thyristor Tn can be kept in an on state.

Figure 6B:
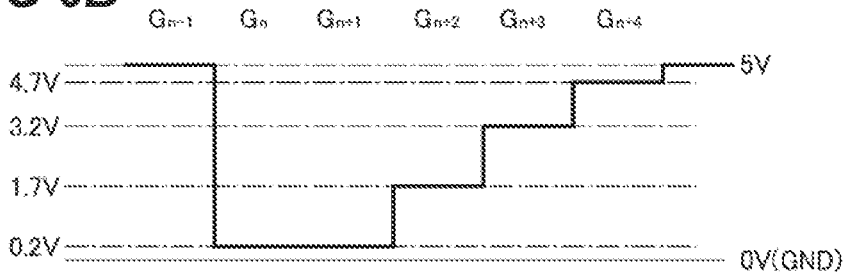

For the shift thyristor connected to the transfer line Φ1, the threshold voltage of the shift thyristor Tn+1 having the lowest threshold voltage is 3.2 V (=1.7 V+1.5 V). The shift thyristor Tn+3 (not illustrated in FIG. 5) having the next lowest threshold voltage is 6.2 V (=4.7 V+1.5 V). In this state, when 5 V is input to the transfer line Φ1, only the shift thyristor Tn+1 can transition to the ON state. In this state, the shift thyristor Tn and the shift thyristor Tn+1 are simultaneously turned on. Therefore, the gate potentials of the shift thyristors Tn+1 to Tn+2 and Tn+3 provided on the right side in the circuit diagram of FIG. 5 are lowered by the diffusion potential (1.5 V). However, since the voltage of the gate line VGK is 5 V and the voltage of the common gate of the light-emitting thyristor L is limited by the voltage of the gate line VGK, the gate potential on the right side of the shift thyristor Tn+5 is 5 V. FIG. 6B is a diagram illustrating gate voltage distributions of the common gates Gn−1 to Gn+4 at this time, and the vertical axis represents the gate potential.

Figure 6C:
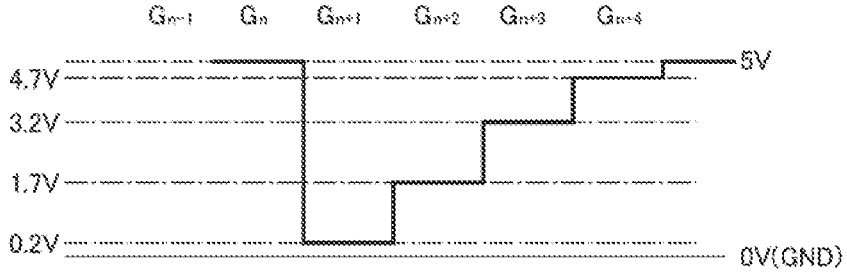

In this state, when the potential of the transfer line Φ2 is lowered to 0 V, the shift thyristor Tn is turned off, and the potential of the common gate Gn of the shift thyristor Tn rises to the VGK potential. FIG. 6C is a diagram illustrating gate voltage distributions at this time, and the vertical axis represents the gate potential. In this way, the transfer of the ON state from the shift thyristor Tn to the shift thyristor Tn+1 is completed.

Next, the light emission operation of the light-emitting thyristor will be described. When only the shift thyristor Tn is turned on, the gates of the four light-emitting thyristors L4*n*−3 to L4*n* are commonly connected to the common gate Gn of the shift thyristor Tn. Therefore, the gate potentials of the light-emitting thyristors L4*n*−3 to L4*n* are 0.2 V, which is the same as that of the common gate Gn. Therefore, the threshold value of each light-emitting thyristor is 1.7 V (=0.2 V+1.5 V), and when a voltage of 1.7 V or more is input from the turn-on signal lines ΦW1 to ΦW4 of the light-emitting thyristor, the light-emitting thyristors L4*n*−3 to L4*n* can be turned on. Therefore, when the shift thyristor Tn is turned on, by inputting a turn-on signal to the turn-on signal lines ΦW1 to ΦW4, the four light-emitting thyristors L4*n*−3 to L4*n* can be caused to selectively emit light. At this time, the potential of the common gate Gn+1 of the shift thyristor Tn+1 adjacent to the shift thyristor Tn is 1.7 V, and the threshold voltages of the light-emitting thyristors L4*n*+1 to 4n+4 gate-connected to the common gate Gn+1 is 3.2 V (=1.7 V+1.5 V).

Since the turn-on signal input from the turn-on signal lines ΦW1 to ΦW4 is 5 V, the light-emitting thyristors L4*n*+1 to L4*n*+4 are also likely to light up in the same lighting pattern as the lighting patterns of the light-emitting thyristors L4*n*−3 to L4*n*. However, since the threshold voltages of the light-emitting thyristors L4*n*−3 to L4*n* are lower, when the turn-on signals are input from the turn-on signal lines ΦW1 to ΦW4, the light-emitting thyristors L4*n*−3 to L4*n* are turned on earlier than the light-emitting thyristors L4*n*+1 to L4*n*+4. Once the light-emitting thyristors L4*n*−3 to L4*n* are turned on, the connected turn-on signal lines ΦW1 to ΦW4 are pulled down to about 1.5 V (the diffusion potential). Therefore, since the potentials of the turn-on signal lines ΦW1 to ΦW4 are lower than the threshold voltages of the light-emitting thyristors L4*n*+1 to L4*n*+4, the light-emitting thyristors L4*n*+1 to L4*n*+4 cannot be turned on. In this manner, the plurality of light-emitting thyristors L can be simultaneously turned on by connecting the plurality of light-emitting thyristors L to one shift thyristor T.

Figure 7:
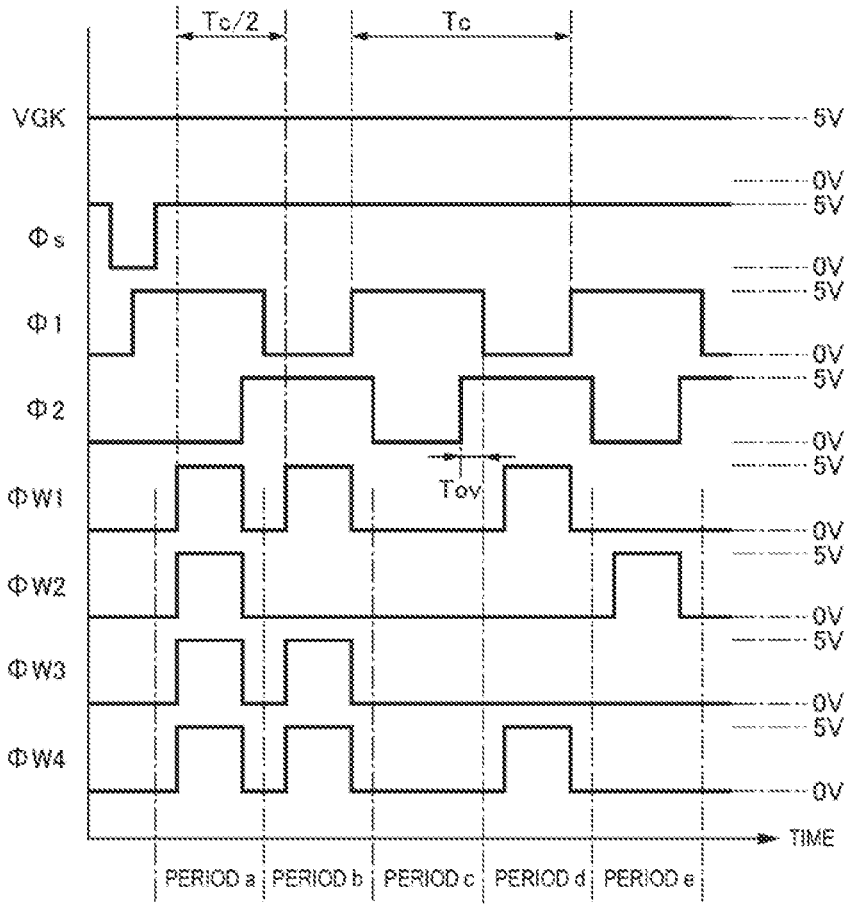
FIG. 7 is a diagram illustrating a drive signal waveform of the light emitting element array chip.

FIG. 7 is a timing chart of the drive signal of the SLED circuit illustrated in FIG. 5. FIG. 7 illustrates voltage waveforms of drive signals of the gate line VGK, the start pulse line Φs, the transfer lines Φ1 and Φ2 of the odd-numbered and even-numbered shift thyristors, and the turn-on signal lines ΦW1 to ΦW4 of the light-emitting thyristors in order from the top. Each drive signal has a voltage of 5 V in an ON state and a voltage of 0 V in an OFF state. The horizontal axis in FIG. 7 indicates time. Furthermore, Tc indicates a cycle of the clock signal Φ1, and Tc/2 indicates a cycle that is half (=½) of the cycle Tc.

The gate line VGK is always supplied with 5 V. In addition, the clock signal Φ1 for the odd-numbered shift thyristor and the clock signal D2 for the even-numbered shift thyristor are input at the same cycle Tc, and the signal Φs of the start pulse line is supplied with 5 V. Shortly before the clock signal Φ1 for the odd-numbered shift thyristor is initially 5 V, the start pulse line signal Φs is dropped to 0 V in order to make a potential difference in the gate line VGK. As a result, the gate potential of the first shift thyristor Tn−1 is drawn from 5 V to 1.7 V, the threshold voltage becomes 3.2 V, and the shift thyristor can be turned on by a signal from the transfer line Φ1. After 5 V is applied to the transfer line Φ1 and the first shift thyristor Tn−1 transitions to the ON state, 5 V is supplied to the start pulse line Φs slightly later, and thereafter, 5 V continues to be supplied to the start pulse line Φs.

The transfer line Φ1 and the transfer line Φ2 have a time Tov at which their ON states (here, 5 V) overlap with each other, and have a substantially complementary relationship. The turn-on signal lines ΦW1 to ΦW4 of the light-emitting thyristors are transmitted at a half cycle of the cycle of the transfer lines Φ1 and Φ2, and are turned on when 5 V is applied when the corresponding shift thyristor is in the ON state. For example, in a period a, all the four light-emitting thyristors connected to the same shift thyristor are turned on, and in a period b, the three light-emitting thyristors are turned on at the same time point. In addition, in a period c, all the light-emitting thyristors are in the turn-off state, and in a period d, the two light-emitting thyristors are lit at the same time. In a period e, only one light-emitting thyristor is lit.

In the present embodiment, the number of light-emitting thyristors connected to one shift thyristor is four, but is not limited thereto, and may be less than or more than four depending on the application. In the circuit described above, the circuit in which cathodes of the thyristors are common has been described, but the present invention can also be applied to an anode common circuit by appropriately inverting the polarity.

<Chip Data Conversion Portion and Chip Data Shift Portion>

Next, configurations of the chip data conversion portion 78 and the chip data shift portion 79 will be described.

Figure 8:
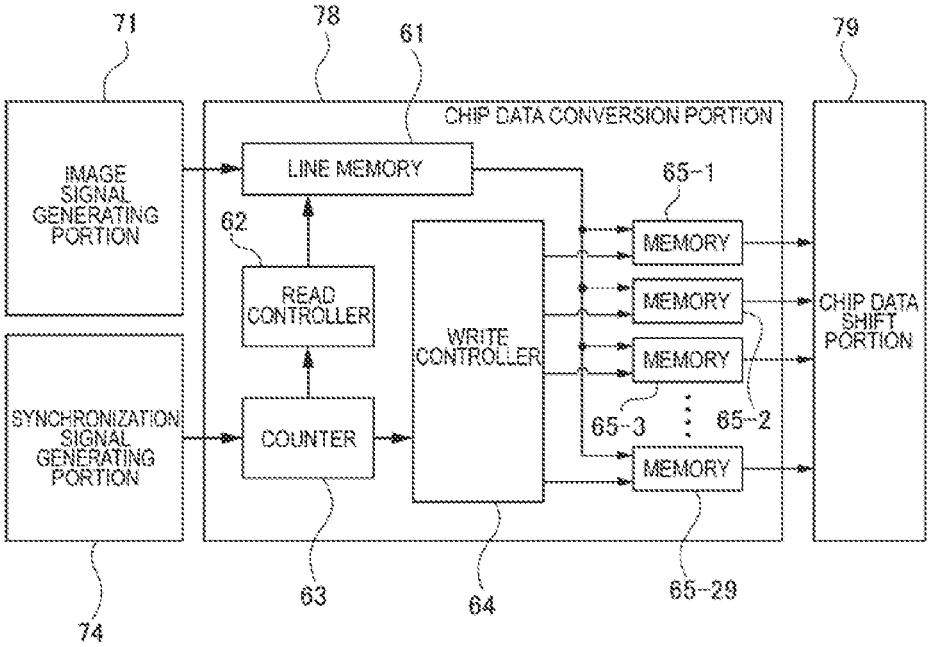
FIG. 8 is a block diagram illustrating a configuration of a chip data conversion portion.
Figure 9:
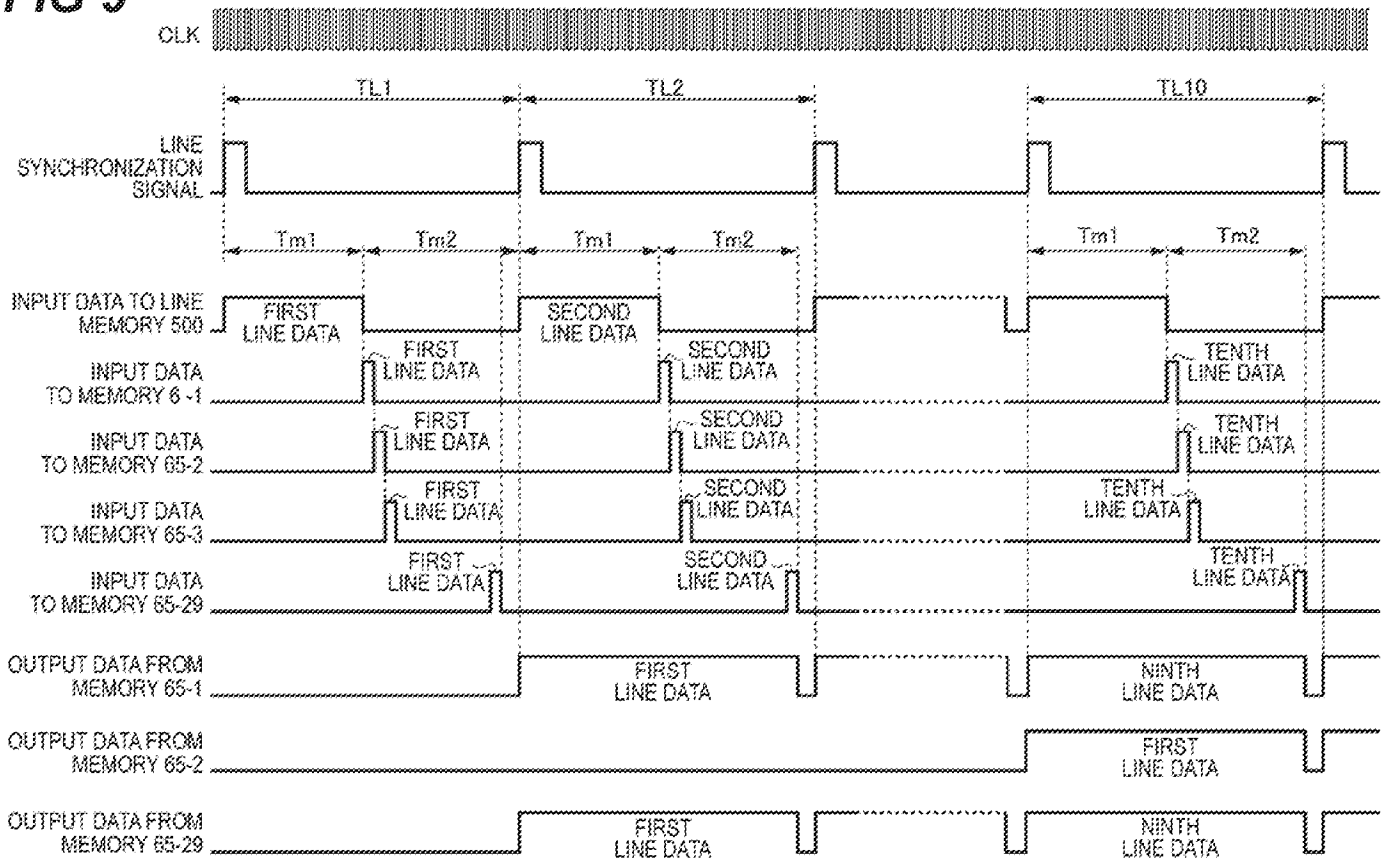
FIG. 9 is a timing chart illustrating operations of the chip data conversion portion and a chip data shift portion.

FIG. 8 is a block diagram illustrating a configuration of a chip data conversion portion 78. FIG. 9 is a timing chart illustrating operations of the chip data conversion portion 78 and the chip data shift portion 79. The first line data illustrated in FIG. 9 means an image signal for one line in a main scanning direction in the first line in the sub-scanning direction. The second line data illustrated in FIG. 9 means an image signal for one line in the main scanning direction in the second line in the sub-scanning direction. The same applies to the third line data and subsequent lines.

As illustrated in FIG. 8 and FIG. 9, the chip data conversion portion 78 includes a line memory 61, a read controller 62, a counter 63, a write controller 64, and memories 65-1 to 65-29. The memories 65-1 to 65-29 are First In First Out Memories (FIFO memories) including 29 memory areas. Each of the 29 memory regions is arranged such that image signals used in the light emitting element array chips 40-1 to 40-29 are arranged in a predetermined transmission order.

The counter 63 performs a counting operation of 29928 which is twice the number of 14964 which is the number of image signals (the number of pixels) of one line in the main scanning direction. Here, a period until the count value reaches 1 to 14964 is a period Tm1 (FIG. 9), and a period until the count value reaches 14965 to 29928 is a period Tm2

(FIG. 9). When the line synchronization signal is input from the synchronization signal generating portion 74, the counter 63 resets the count value to 0, and then increments the count value in synchronization with the reference clock signal.

The read controller 62 reads data corresponding to the count value of the counter 63 and stores image signals (14964) for one line in the line memory 61 during the period Tm1. The write controller 64 divides and writes the image signal of one line from the line memory 61 to each of the memories 65-1 to 65-29 during the period Tm2.

Specifically, the write controller 64 first reads an image signal for one line from the line memory 61, and writes the image signal to be used in the light emitting element array chip 40-1 into the memory 65-1 that stores the image signal. Next, the write controller 64 writes an image signal used in the light emitting element array chip 40-2 into the memory 65-2 that stores the image signal. In this manner, the write controller 64 continuously writes image signals to the memories 65-1 to 65-29.

The memories 65-1 to 65-29 store image signals for 10 lines in order to cope with a shift operation of the image signal in the sub-scanning direction of the chip data shift portion 79 described later.

The image signals for 10 lines are image signals for a total of 10 lines including 2 lines for position correction in the sub-scanning direction for coping with the mounting position shift of the light emitting element array chip 40 and 8 lines as an interval between two light emitting element array chips 40 adjacent in the sub-scanning direction.

By such an operation, the chip data conversion portion 78 stores the image signal input from the image signal generating portion 71 in the line memory 61, and then divides and stores the image signal for one line in the memories 65-1 to 65-29 corresponding to the light emitting element array chips 40-1 to 40-29, respectively. The image signals stored in the memories 65-1 to 65-29 are read at predetermined timing by the chip data shift portion 79.

The chip data shift portion 79 controls the timing of reading the image signal from the memories 65-1 to 65-29 to shift the image signal in the sub-scanning direction. Specifically, the chip data shift portion 79 shifts the image signal in the leading end direction of the sheet S by advancing the timing of reading the image signal from the memories 65-1 to 65-29. For example, the chip data shift portion 79 advances the timing of reading the image signal by one cycle of the line synchronization signal. As a result, the image signal for one line is shifted.

As illustrated in FIG. 9, in the present embodiment, the chip data shift portion 79 reads the image signal of the first line from the memories 65-1, 65-3, . . . , and 65-29 corresponding to the odd-numbered light emitting element array chips 40-1, 40-3, . . . , and 40-29 in the period TL2. In addition, the chip data shift portion 79 reads the image signal of the first line from the memories 65-2, 65-4, . . . , and 65-28 corresponding to the even-numbered light emitting element array chips 40-2, 40-4, . . . , 40-28 in a period TL10 that is a period after nine pulses by the line synchronization signal from the period TL1 that is a write period to the memory. Thus, the exposure timing is controlled according to the interval (for 8 pixels at 2400 dpi) in the sub-scanning direction of a staggered arrangement (two rows).

In the present embodiment, the clock frequency is determined such that the count value of the counter 63 during one cycle of the line synchronization signal is 29928 or more (twice the number of image signals of one line). As a result, it is possible to input an image signal to the line memory 61 and input an image signal to the memories 65-1 to 65-29 during one cycle of the line synchronization signal.

In addition, the chip data shift portion 79 reads image signals for one line in parallel from the memories 65-1 to 65-29 during one cycle of the line synchronization signal. Therefore, the reading speed of the image signal of the chip data shift portion 79 may be lower than the writing speed of the image signal to the line memory 61 and the memories 65-1 to 65-29. In the present embodiment, the time required for writing the image signal to the line memory 61 and the time required for writing the image signal to the memories 65-1 to 65-29 are set to be the same as the time required for the chip data shift portion 79 to read the image signal for one line from the memories 65-1 to 65-29. That is, the chip data shift portion 79 reads the image signals from the memories 65-1 to 65-29 at a cycle 58 times the write clock to the memories 65-1 to 65-29.

Figure 10:
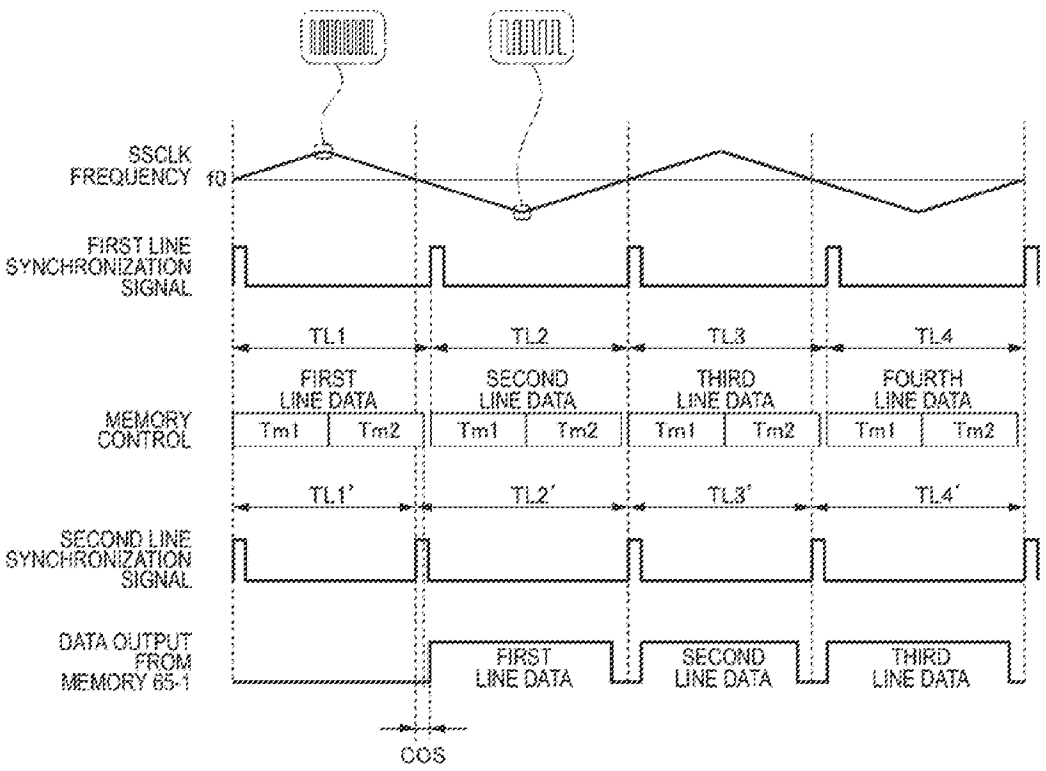
FIG. 10 is a diagram illustrating an operation of the chip data conversion portion.

FIG. 10 is a diagram illustrating an operation of the chip data conversion portion 78. The SSCLK frequency illustrated in FIG. 10 is a frequency obtained by plotting the frequency of the modulated clock signal with a reference frequency f0 as the center. The first line synchronization signal illustrated in FIG. 10 is a signal generated by the synchronization signal generating portion 74 based on the reference clock signal. The second line synchronization signal illustrated in FIG. 10 is a signal generated by the synchronization signal generating portion 74 based on the modulated clock signal.

As illustrated in FIG. 10, the chip data conversion portion 78 writes the image signal to the line memory 61, reads the image signal from the line memory 61, and writes the image signal to the memories 65-1 to 65-29 based on the reference clock signal. In addition, the chip data conversion portion 78 outputs data from the memories 65-1 to 65-29 based on the modulated clock signal.

Since the second line synchronization signal is generated based on the modulated clock signal, the cycle (TL1' to TL4') of the second line synchronization signal is shorter during the period in which the frequency of the modulated clock signal is high and longer during the period in which the frequency is low than the cycle (TL1 to TL4) of the first line synchronization signal. Therefore, by offsetting the data output timing from the memories 65-1 to 65-29 with reference to the second line synchronization signal (COS illustrated in FIG. 10), a positional relationship between the periods Tm1 and Tm2 of the memory control synchronized with the first line synchronization signal and the data outputs from the memories 65-1 to 65-29 synchronized with the second line synchronization signal varies. As a result, the write period and the read period for the memories 65-1 to 65-29 are controlled so as not to overlap.

<Data Receiving Portion>

Next, a configuration of the data receiving portion 81 will be described.

As described above, the data transmitting portion 72 superimposes the modulated clock signal on the image signal and then transmits the image signal to the data receiving portion 81. On the other hand, the data receiving portion 81 includes a phase locked loop circuit (PLL circuit) 45 using a clock data recovery (CDR) technology that extracts a modulated clock signal from the data received from the data transmitting portion 72. Hereinafter, the configuration of the PLL circuit 45 (an extraction circuit) of the data receiving portion 81 will be described.

Figure 11A:
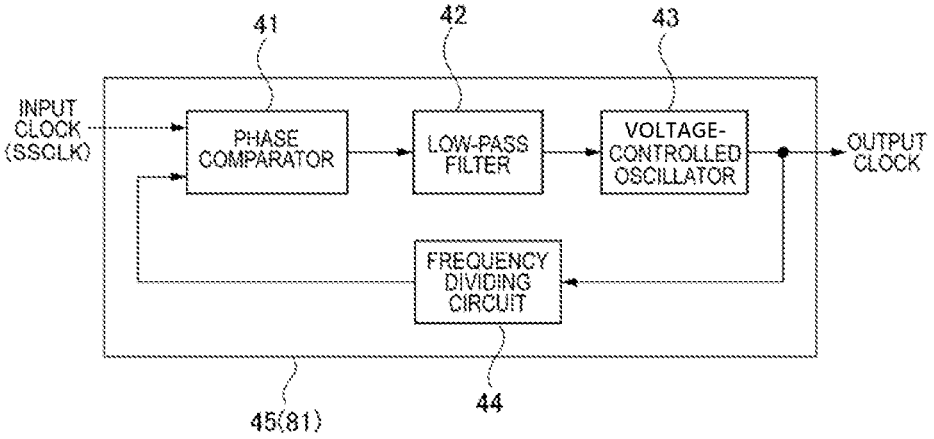
FIG. 11A and FIG. 11B are block diagrams illustrating a configuration of a PLL circuit.
Figure 11B:
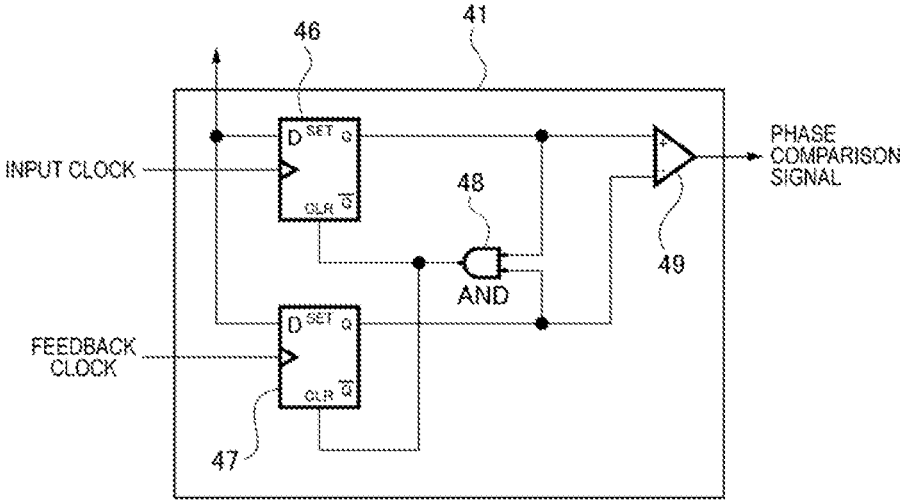
Figure 12:
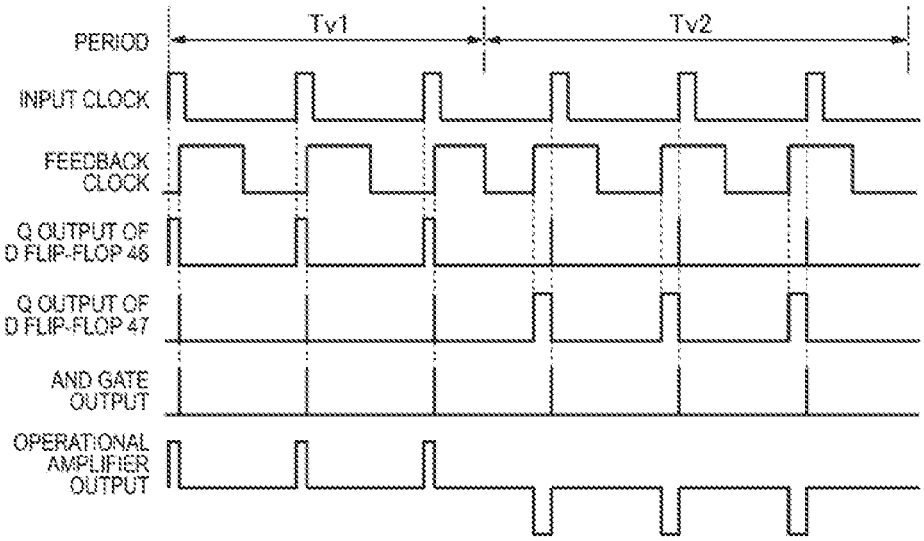
FIG. 12 is a timing chart illustrating an operation of a phase comparator.

FIG. 11A is a block diagram illustrating a configuration of the PLL circuit 45. FIG. 11B is a block diagram illustrating a configuration of a phase comparator 41 of the PLL circuit 45. FIG. 12 is a timing chart illustrating an operation of the phase comparator 41.

As illustrated in FIG. 11A, the PLL circuit 45 includes the phase comparator 41, a low-pass filter 42, a voltage-controlled oscillator 43, and a frequency dividing circuit 44. The modulated clock signal transmitted from the data transmitting portion 72 and extracted by the PLL circuit 45 based on a data change point is input to the phase comparator 41 as an input clock. In addition, the output clock of the PLL circuit 45 is input to the phase comparator 41 as a feedback clock after being divided by the frequency dividing circuit 44. The phase comparator 41 compares the input clock with the feedback clock, and outputs a phase comparison signal according to a comparison result, with a configuration to be described next.

As illustrated in FIG. 11B, the phase comparator 41 includes D flip-flops 46 and 47, an AND gate 48, and an operational amplifier 49. As illustrated in FIG. 12, Q outputs of the D flip-flops 46 and 47 in the initial state are low. The Q output of D flip-flop 46 goes high when the input clock rises. The Q output of D flip-flop 47 goes high when the feedback clock rises.

In the period Tv1 illustrated in FIG. 12, when the input clock rises before the feedback clock rises, the Q output of the D flip-flop 46 becomes high. Thereafter, when the feedback clock rises, the Q output of the D flip-flop 47 becomes high, but immediately thereafter, the AND gate 48 outputs high, and both the D flip-flops 46 and 47 are cleared, and the Q outputs of both the D flip-flops are returned to low. That is, the D flip-flop 46 outputs high by the delay time of the feedback clock with respect to the input clock.

In the period Tv2 illustrated in FIG. 12, when feedback clock rises before the input clock rises, the Q output of the D flip-flop 47 becomes high. Thereafter, when the input clock rises, the Q output of the D flip-flop 46 becomes high, but immediately thereafter, the AND gate 48 outputs high, and both the D flip-flops 46 and 47 are cleared, and the Q outputs of both the D flip-flops are returned to low. That is, the D flip-flop 47 outputs high by the lead time of the feedback clock with respect to the input clock.

The operational amplifier 49 adds the Q output of the D flip-flop 46 as a positive value and the Q output of the D flip-flop 47 as a negative value. The time average of the output values of the operational amplifier 49 is as follows with a case where there is no phase difference between the input clock and the feedback clock as 0 (reference). That is, as the phase of the feedback clock is delayed with respect to the phase of the input clock, a value having a larger absolute value is output as a positive value. As the phase of the feedback clock advances with respect to the phase of the input clock, a value having a larger absolute value is output as a negative value. A pulsed output signal of the operational amplifier 49 is a phase comparison signal output from the phase comparator 41.

The low-pass filter 42 reduces and smooths a frequency component higher than the cut-off frequency in the phase comparison signal output from the phase comparator 41, and outputs a phase signal indicating a phase advance or delay with high and low voltages. As described above, since the phase comparison signal has a pulse shape, an analog signal can be obtained by reducing a high-frequency component of the signal by the low-pass filter 42, and the voltage-controlled oscillator 43 can be smoothly controlled.

When the cut-off frequency of the low-pass filter 42 is too high, a sufficiently smoothed analog signal cannot be obtained, and when the cut-off frequency is too low, control is delayed. When the frequency component higher than the cut-off frequency in the modulated clock signal is reduced by the low-pass filter 42, as described later, there is a possibility that the image signal transmitted from the data transmitting portion 72 is not normally received by the data receiving portion 81. Therefore, it is desirable to set the cut-off frequency in consideration of these points.

The voltage-controlled oscillator 43 increases the frequency of the signal in a case where the phase signal output from the low-pass filter 42 is delayed with respect to the reference signal, and decreases the frequency of the signal in a case where the phase signal is advanced. By such an operation, the PLL circuit 45 performs feedback control so that the phase of the output clock matches the phase of the reference signal.

<SSCLK Generating Portion>

Next, a configuration of the SSCLK generating portion 69 will be described.

Figure 13A:
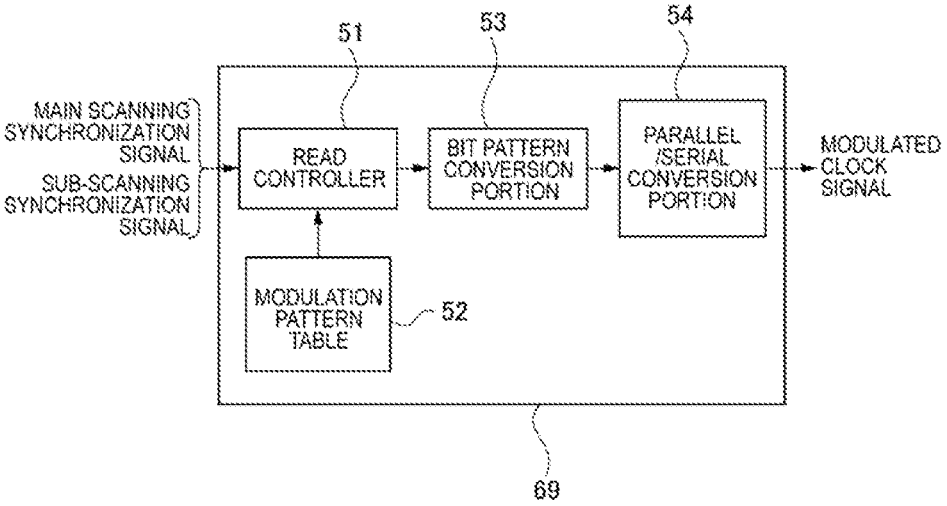
FIG. 13A is a block diagram illustrating a configuration of an SSCLK generating portion.
Figure 13B:
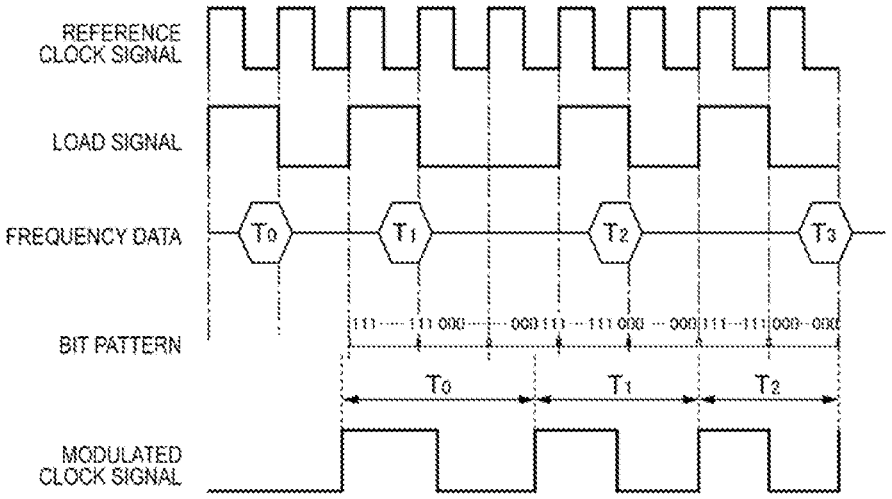
FIG. 13B is a timing chart illustrating an operation of the SSCLK generating portion.
Figure 14A:
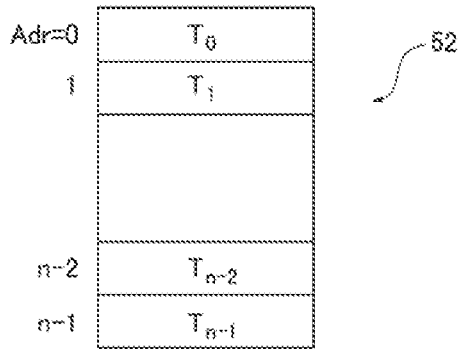
FIG. 14A is a diagram illustrating a modulation pattern table.
Figure 14B:
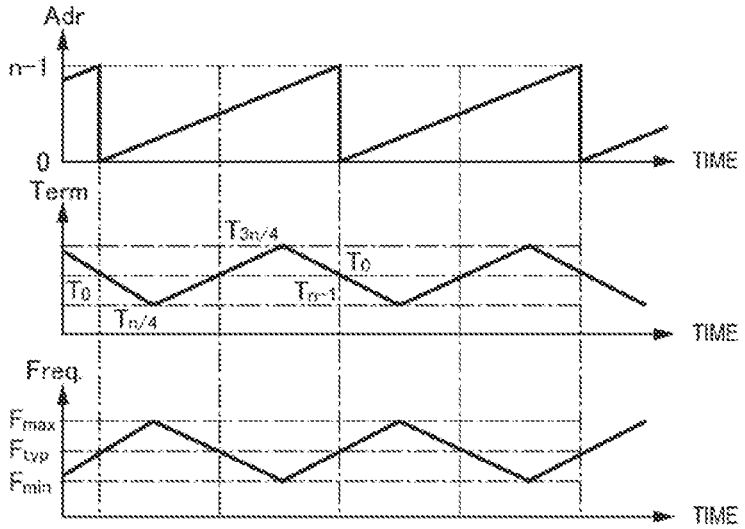
FIG. 14B is a diagram illustrating a read operation of a modulation pattern table by a read controller.

FIG. 13A is a block diagram illustrating a configuration of the SSCLK generating portion 69. FIG. 13B is a timing chart illustrating an operation in which the SSCLK generating portion 69 generates a modulated clock signal. FIG. 14A is a diagram illustrating a modulation pattern table 52. FIG. 14B is a diagram illustrating a read operation of the modulation pattern table 52 by a read controller 51.

As illustrated in FIG. 13A, the SSCLK generating portion 69 includes the read controller 51, the modulation pattern table 52 (a storage unit), a bit pattern conversion portion 53, and a parallel/serial conversion portion 54 (a serial signal generating unit).

The read controller 51 receives the load signal output from the bit pattern conversion portion 53 and reads data corresponding to a cycle of one clock of the modulated clock signal to be the output clock of the SSCLK generating portion 69 from the modulation pattern table 52. The bit pattern conversion portion 53 outputs a load signal to the read controller 51 so that the bit pattern does not overflow.

As illustrated in FIG. 14A, n pieces of cycle data T0 to Tn−1 of addresses 0 to n−1 are stored in the modulation pattern table 52. The cycle data T0 to Tn−1 are cycle data corresponding to one modulation cycle of frequency modulation by spread spectrum performed by the SSCLK generating portion 69. That is, the SSCLK generating portion 69 generates a modulated clock signal having a waveform based on the cycle data T0 to Tn−1. That is, the modulation pattern table 52 stores a pattern of frequency modulation by spread spectrum performed by the SSCLK generating portion 69.

In addition, Adr, Term, and Freq illustrated in FIG. 14B have the following meanings. The Adr is an address for reading the modulation pattern table 52 output by the read controller 51. The Freq is a frequency modulated by spread spectrum by the SSCLK generating portion 69. The Term is the cycle data obtained by converting the frequency Freq for each time into a cycle, and is a value obtained by the read controller 51 reading the cycle data T0 to Tn−1 stored in the modulation pattern table 52.

The bit pattern conversion portion 53 converts the cycle data Term into a bit pattern. Specifically, the bit pattern conversion portion 53 converts the cycle data Term into INT (Term/2) consecutive bit patterns of "1" and Term-INT (Term/2) consecutive bit patterns of "0". For example, the bit pattern conversion portion 53 converts the bit pattern into a bit pattern "11110000" in a case of Term=8, and converts the bit pattern into a bit pattern "1110000" in a case of Term=7.

In addition, the bit pattern conversion portion 53 outputs a bit pattern to the parallel/serial conversion portion 54 by a predetermined number of bits for each reference clock signal. Upon receiving the bit pattern, the parallel/serial conversion portion 54 generates a modulated clock signal as a high signal when the bit pattern is "1" and a low signal when the bit pattern is "0" in order from the upper bit according to the multiplied clock generated therein. In this manner, the SSCLK generating portion 69 generates the modulated clock signal.

In addition, a vertical dotted line illustrated in FIG. 14B corresponds to the trigger timing of the main scanning synchronization signal. The read controller 51 initializes the Adr to 0 at the timing of receiving the sub-scanning synchronization signal, increments the Adr over two cycles of the main scanning synchronization signal, receives the sub-scanning synchronization signal every two cycles of the main scanning synchronization signal, and initializes the Adr to 0. As a result, the SSCLK generating portion 69 outputs the modulated clock signal according to the main scanning synchronization signal.

Figure 15A:
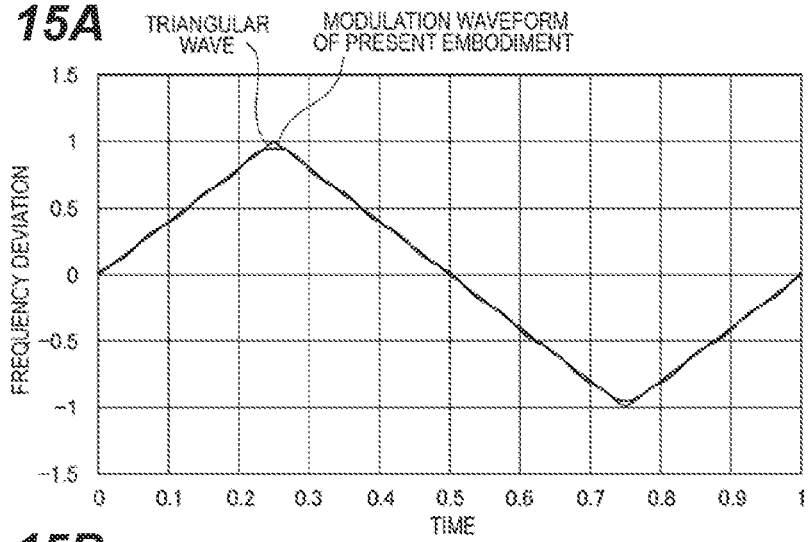
FIG. 15A, FIG. 15B and FIG. 15Ca are graphs illustrating the modulation waveform for one cycle of the frequency modulation by spread spectrum.

FIG. 15A is a graph illustrating a modulation waveform for one cycle of the modulated clock signal stored in the modulation pattern table 52 described above. As illustrated in FIG. 15A, the waveform of the modulated clock signal is a waveform obtained by combining the fundamental wave when the triangular wave is subjected to Fourier series expansion with a third harmonic, a fifth harmonic, and a seventh harmonic. That is, the modulation waveform of frequency modulation by spread spectrum in the present embodiment approximates a triangular wave, but is band-limited to an odd-order harmonic including the fundamental wave and the seventh harmonic when the triangular wave is subjected to the Fourier series expansion.

Figure 15B:
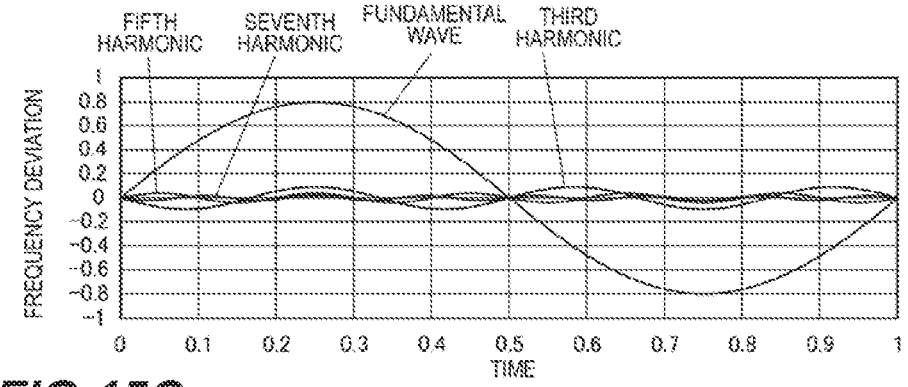
Figure 15C:
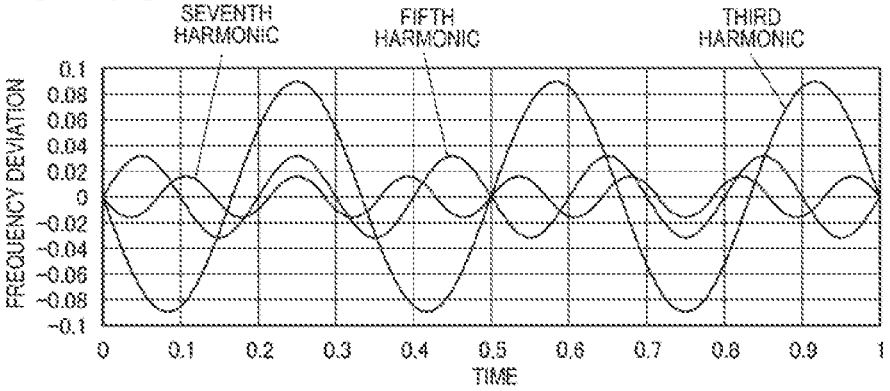

The modulation waveform illustrated in FIG. 15A is obtained by converting the frequency change of the waveform illustrated in FIG. 15B into a form of cycle stacking. The waveforms illustrated in FIG. 15B are waveforms of the fundamental wave, the third harmonic, the fifth harmonic, and the seventh harmonic when the triangular wave is subjected to the Fourier series expansion. The Fourier series of each waveform is 0.81057 for the fundamental wave, −0.0901 for the third harmonic, 0.03242 for the fifth harmonic, and −0.0165 for the seventh harmonic. The waveform illustrated in FIG. 15C is a waveform in which the scale of the vertical axis is enlarged by extracting the above-described third harmonic, fifth harmonic, and seventh harmonic.

Figure 16:
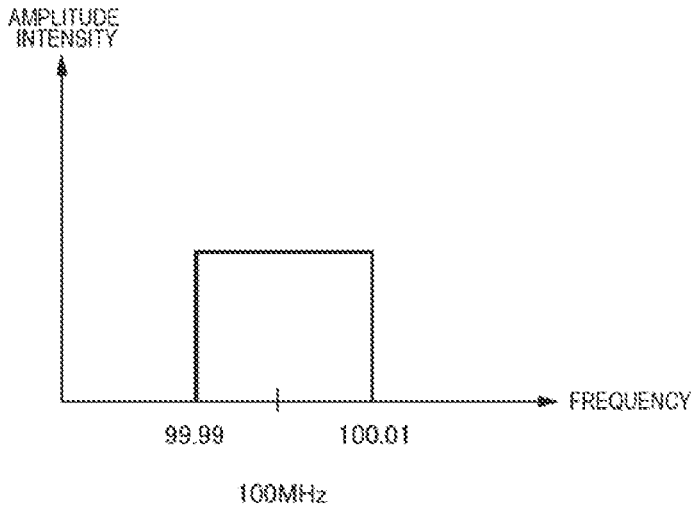
FIG. 16 is a graph illustrating frequency characteristics around a center frequency in a case where the modulation waveform of spread spectrum is a triangular wave.

FIG. 16 is a graph illustrating frequency characteristics around the center frequency in a case where the modulation waveform of spread spectrum by the SSCLK generating portion 69 is a triangular wave. As illustrated in FIG. 16, in a case where the modulation waveform is a triangular wave, the SSCLK generating portion 69 changes the frequency between the minimum frequency and the maximum frequency at an equal ratio. Therefore, the amplitude intensity has an average distribution with respect to the frequency, and the frequency deviation is suppressed, which is effective for countermeasures against radiation noise.

However, as can be seen by Fourier series expansion of the triangular wave, the triangular wave includes the fundamental wave and infinite odd-order harmonic components. Therefore, when the harmonic component equal to or higher than the cut-off frequency of the low-pass filter 42 among the harmonic components is reduced by the PLL circuit 45, the modulated clock signal transmitted from the data transmitting portion 72 and the modulated clock signal processed by the PLL circuit 45 become signals having different cycles. That is, since the cycles of the clock signals are different between the transmission side and the reception side, the signal is not normally transmitted and received between the data transmitting portion 72 and the data receiving portion 81, and the exposure head 6 cannot normally receive the image signal, and there is a possibility that a part of the image formed on the sheet S is missing.

Figure 17:
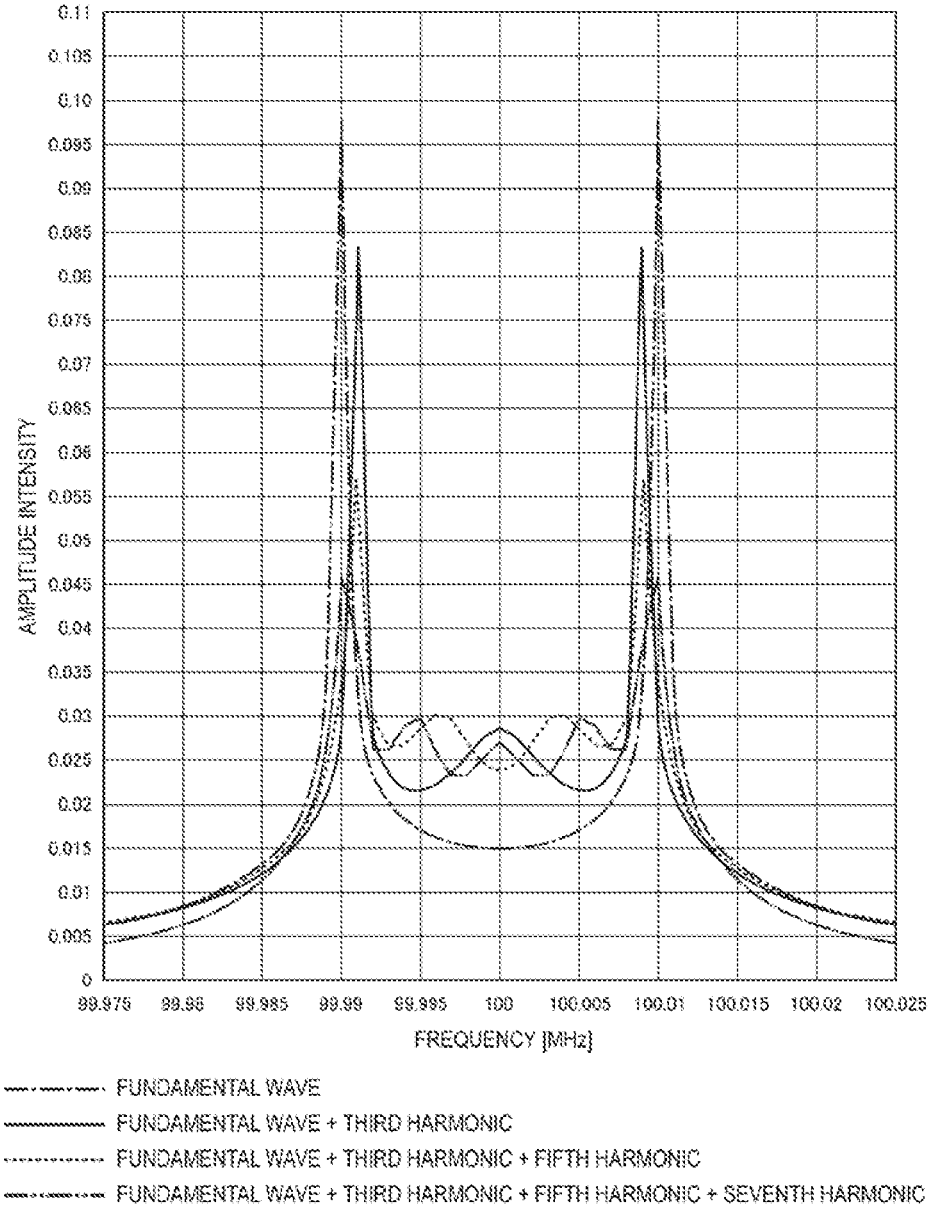
FIG. 17 is a graph illustrating frequency characteristics around the center frequency in a case where the modulation waveform of spread spectrum by the SSCLK generating portion is a composite wave obtained by combining a fundamental wave and a predetermined odd-order harmonic when a triangular wave is subjected to Fourier series expansion.

FIG. 17 is a graph illustrating frequency characteristics around the center frequency in a case where the modulation waveform of spread spectrum by the SSCLK generating portion 69 is a composite wave obtained by combining a fundamental wave and a predetermined odd-order harmonic when a triangular wave is subjected to Fourier series expansion. As illustrated in FIG. 17, when the modulation waveform is only the fundamental wave, the frequency changes slowly in the vicinity of the minimum frequency and the vicinity of the maximum frequency, and changes relatively quickly in the period therebetween. Therefore, the amplitude intensity has a distribution biased to the vicinity of the minimum frequency and the vicinity of the maximum frequency, and the effect of dispersing the frequency is small, which is disadvantageous for countermeasures against radiation noise.

On the other hand, as the modulation waveform of spread spectrum by the SSCLK generating portion 69, the frequency deviation decreases and the frequency is spread as the number of odd-order harmonics to be synthesized with the fundamental wave when the triangular wave is subjected to the Fourier series expansion increases. For example, in the case of only the fundamental wave, although there are two maximum points of the maximum frequency and the minimum frequency in the modulation range, there are three or more maximum points when the odd-order harmonic is combined with the fundamental wave.

That is, as in the configuration of the present embodiment, the following effects can be obtained by setting the waveform of the modulated clock signal to a waveform obtained by combining the fundamental wave when the triangular wave is subjected to the Fourier series expansion with the third harmonic, the fifth harmonic, and the seventh harmonic. That is, while the radiation noise is suppressed by dispersing the frequency, the harmonic to be synthesized with the fundamental wave when the triangular wave is subjected to the Fourier series expansion is band-limited up to the seventh harmonic, and the modulated clock signal can be suppressed from being reduced by the low-pass filter 42. Therefore, it is possible to achieve both suppression of the radiation noise and suppression of the image signal not being normally received by the exposure head 6.

Although the present embodiment has described the configuration in which the waveform of the modulated clock signal is a waveform obtained by combining the fundamental wave obtained by the Fourier series expansion of the triangular wave with the third harmonic, the fifth harmonic, and the seventh harmonic, the present invention is not limited thereto. That is, the above-described effect can be obtained by setting the waveform of the modulated clock signal to a waveform obtained by combining the fundamental wave and the odd-order finite harmonic when the triangular wave is subjected to the Fourier series expansion. That is, by setting the waveform of the modulated clock signal to a waveform obtained by combining a predetermined harmonic of an odd order with a fundamental wave when the triangular wave is subjected to the Fourier series expansion, it is possible to prevent the modulated clock signal from being reduced by the low-pass filter 42 as compared with the triangular wave, and it is possible to enhance the effect of suppressing radiation noise by dispersing the frequency as compared with the waveform of only the fundamental wave. Therefore, the cut-off frequency of the low-pass filter 42 is set in consideration of signal smoothness and control responsiveness. Then, according to the set cut-off frequency, the odd-order harmonics to be synthesized with the fundamental wave when the triangular wave is subjected to the Fourier series expansion may be set such that the modulated clock signal is not reduced by the low-pass filter 42.

Second Embodiment

Next, a second embodiment of an image forming apparatus according to the present invention will be described. Portions overlapping with those of the first embodiment are denoted by the same reference numerals, and description thereof is omitted.

The configuration of the present embodiment is different from the configuration of the first embodiment in the configuration of the SSCLK generating portion 69. Other configurations of the image forming apparatus A according to the present embodiment are similar to those of the first embodiment.

Figure 18A:
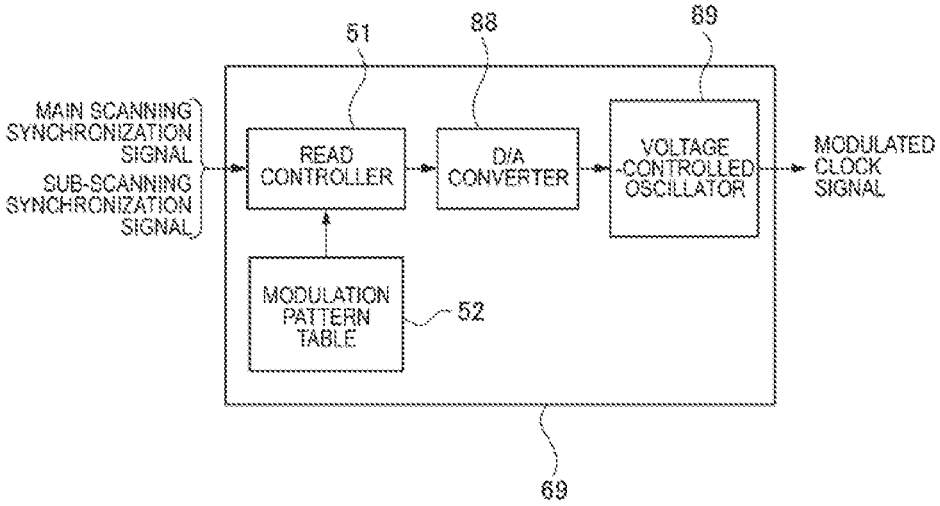
FIG. 18A is a block diagram illustrating a configuration of the SSCLK generating portion.

FIG. 18A is a block diagram illustrating a configuration of the SSCLK generating portion 69 according to the present embodiment. As illustrated in FIG. 18A, the SSCLK generating portion 69 according to the present embodiment includes the read controller 51, the modulation pattern table 52 (the storage unit), a D/A converter 88 (the conversion portion), and a voltage-controlled oscillator 89 (an output portion).

Similarly to the first embodiment, n pieces of cycle data T0 to Tn−1 are stored in the modulation pattern table 52 from addresses 0 to n−1 illustrated in FIG. 14A. The cycle data T0 to Tn−1 are cycle data corresponding to one modulation cycle of frequency modulation by spread spectrum performed by the SSCLK generating portion 69. That is, the SSCLK generating portion 69 generates a modulated clock signal having a waveform based on the cycle data T0 to Tn−1. The waveform of the modulated clock signal based on the cycle data T0 to Tn−1 in the present embodiment is the same as the waveform in the first embodiment.

Figure 18B:
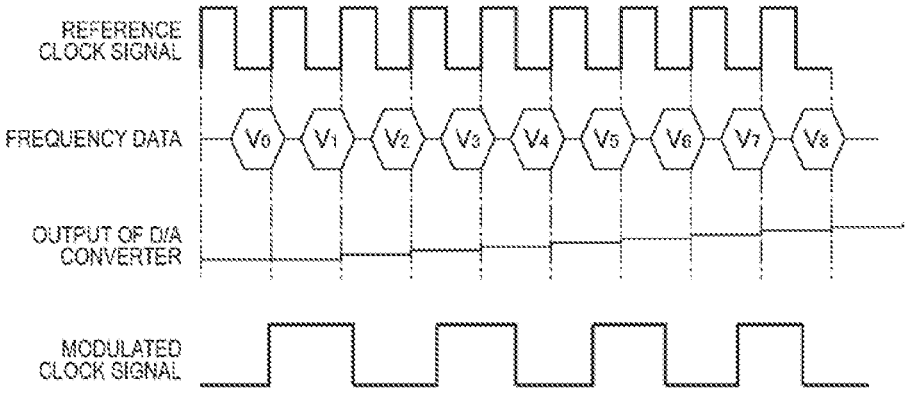
FIG. 18B is a timing chart illustrating an operation in which the SSCLK generating portion generates the modulated clock signal.
Figure 19A:
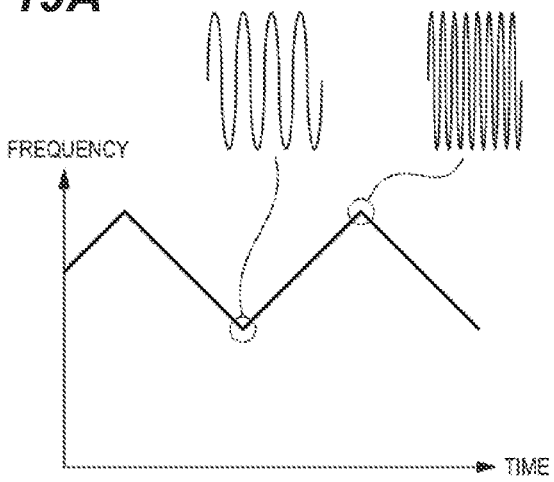
FIG. 19A and FIG. 19B are diagrams illustrating the modulation waveform of the frequency modulation by the spread spectrum.
Figure 19B:
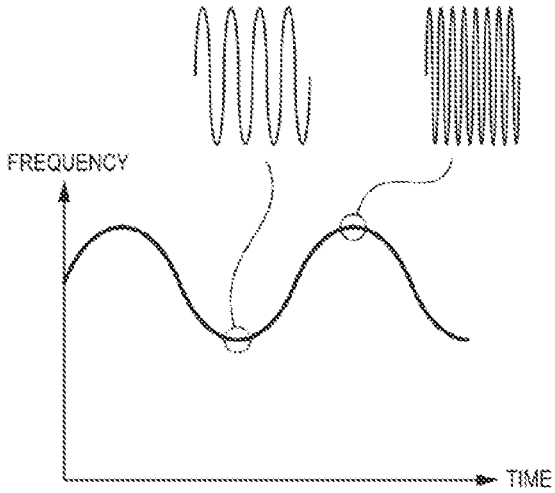

FIG. 18B is a timing chart illustrating an operation in which the SSCLK generating portion 69 generates a modulated clock signal. As illustrated in FIG. 18B, the read controller 51 reads data corresponding to a cycle of one clock of a modulated clock signal to be an output clock of the SSCLK generating portion 69 from the modulation pattern table 52. The D/A converter 88 converts the data output by the read controller 51 into a voltage and outputs the voltage as an analog signal. The voltage-controlled oscillator 89 outputs a modulated clock signal according to the analog signal output by the D/A converter 88.

In the present embodiment, the cycle data is a digital value representing the output voltage of the D/A converter 88 converted from the voltage-frequency characteristic of the voltage-controlled oscillator 89 so that the frequency of the modulated clock signal output from the voltage-controlled oscillator 89 becomes a preset frequency. The frequency data is obtained by sampling the modulation waveform at the cycle of the reference clock signal to obtain the frequency at each sampling time point, obtaining the voltage from the voltage-frequency characteristic of the voltage-controlled oscillator 89, and inversely calculating the data value from the characteristic of the D/A converter 88.

As described above, in the present embodiment, the SSCLK generating portion 69 generates the modulated clock signal using the analog signal by the D/A converter 88 and the voltage-controlled oscillator 89. As a result, since it is not necessary to use a high-speed clock at the time of generating a modulated clock signal, it is not necessary to use a fine configuration as a semiconductor process, and cost can be reduced. In addition, the frequency can be smoothly varied by the analog signal, and the frequency can be further diffused in each frequency band to enhance the effect of countermeasures against radiation noise.

In the first embodiment and the second embodiment, the configuration in which the LED is used as the light emitting portion 50 of the light emitting element array chip 40 has been described, but the present invention is not limited thereto. That is, another type of light source such as an organic EL may be used as the light emitting portion 50 of the light emitting element array chip 40.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2021-074061, filed Apr. 26, 2021, which is hereby incorporated by reference herein in its entirety.

What is claimed is:

1. An image forming apparatus comprising:

a photoreceptor;

an image signal generating unit configured to generate an image signal based on input image data;

a light emitting portion configured to emit light based on the image signal and expose the photoreceptor;

a driving unit configured to drive the light emitting portion;

a first substrate in which the driving unit is provided and a plurality of the light emitting portions is provided in a direction parallel to a rotational axis direction of the photoreceptor;

an exposure head including the first substrate;

a reference clock signal generating unit configured to generate a reference clock signal that is a clock signal of a constant frequency;

a modulated clock signal generating unit configured to generate a modulated clock signal by performing spread spectrum on the reference clock signal, the modulated clock signal being a composite wave in which odd-order harmonics are combined with a fundamental wave when a triangular wave is subjected to Fourier series expansion;

a transmission unit configured to superimpose the modulated clock signal on the image signal and transmit the superimposed signal to the first substrate;

a second substrate on which the image signal generating unit, the modulated clock signal generating unit, and the transmission unit are provided; and an extraction circuit that is mounted on the first substrate and extracts the modulated clock signal from the superimposed signal transmitted from the transmission unit.

2. The image forming apparatus according to claim 1, wherein the extraction circuit includes a low-pass filter configured to cut off a signal having a predetermined frequency or higher.

3. The image forming apparatus according to claim 2, wherein the modulated clock signal generated by the modulated clock signal generating unit is a composite wave in which at least one harmonic of a third harmonic, a fifth harmonic, and a seventh harmonic is combined with a fundamental wave when a triangular wave is subjected to Fourier series expansion, and the low-pass filter cuts off a signal of a harmonic having a higher frequency than a ninth harmonic, which is the predetermined frequency.

4. The image forming apparatus according to claim 3, wherein the modulated clock signal generated by the modulated clock signal generating unit is a composite wave obtained by combining the harmonics of the third harmonic, the fifth harmonic, and the seventh harmonic with the fundamental wave when the triangular wave is subjected to the Fourier series expansion.

5. The image forming apparatus according to claim 2, wherein the modulated clock signal generating unit includes a storage unit configured to store a pattern of frequency modulation by spread spectrum, and a serial signal generating unit configured to generate a serial signal according to the pattern.

6. The image forming apparatus according to claim 2, wherein the modulated clock signal generating unit includes a storage unit configured to store a pattern of frequency modulation by spread spectrum, a conversion unit configured to convert the pattern into an analog signal, and an output unit configured to output the modulated clock signal according to the analog signal.

7. The image forming apparatus according to claim 1, wherein the first substrate and the second substrate are connected with a flexible flat cable.

* * * * *